US009389552B2

(12) United States Patent
Chikazawa et al.

(10) Patent No.: US 9,389,552 B2
(45) Date of Patent: Jul. 12, 2016

(54) IMAGE FORMING APPARATUS WITH FIXING MEMBER TEMPERATURE CONTROL

(71) Applicant: KONICA MINOLTA INC., Chiyoda-ku, Tokyo (JP)

(72) Inventors: Satoshi Chikazawa, Toyokawa (JP); Toshiaki Tanaka, Toyokawa (JP); Kosuke Masumoto, Hachioji (JP); Yasuhiro Ishihara, Toyohashi (JP)

(73) Assignee: KONICA MINOLTA INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/642,181

(22) Filed: Mar. 9, 2015

(65) Prior Publication Data

US 2015/0253706 A1 Sep. 10, 2015

(30) Foreign Application Priority Data

Mar. 10, 2014 (JP) ..... 2014-046780

(51) Int. Cl.
*G03G 15/20* (2006.01)

(52) U.S. Cl.
CPC ..... *G03G 15/2039* (2013.01)

(58) Field of Classification Search
CPC ..... G03G 15/2078; G03G 15/2032; G03G 15/2067; G03G 15/2039; G03G 15/2046
See application file for complete search history.

(56) References Cited

U.S. PATENT DOCUMENTS 6,185,388 B1 * 2/2001 Yamamoto ..... 399/69
2011/0142467 A1 * 6/2011 Ohhashi et al. ..... 399/67
2012/0155907 A1 6/2012 Tanaka
2012/0189338 A1 * 7/2012 Yasuda ..... 399/69
2012/0328308 A1 * 12/2012 Takada ..... 399/33

FOREIGN PATENT DOCUMENTS

JP H11-202672 A 7/1999
JP 2004-287131 A 10/2004
JP 2005-043821 A 2/2005
JP 2012-128037 A 7/2012
JP 2012-128107 A 7/2012
JP 2012-128189 A 7/2012

OTHER PUBLICATIONS

Notice of Reasons for Rejection issued by the Japanese Patent Office on Mar. 1, 2016 in corresponding Japanese Patent Application No. 2014-046780, and an English translation; 13 pages.

* cited by examiner

*Primary Examiner* — Clayton E Laballe
*Assistant Examiner* — Ruifeng Pu
(74) *Attorney, Agent, or Firm* — Buchanan Ingersoll & Rooney PC

(57) ABSTRACT

An image forming apparatus includes: a sheet feeding unit configured to feed a plurality of sheets to an image forming unit one by one; the image forming unit configured to form a toner image based on image data; a fixing unit configured to fix the toner image formed on each sheet by the image forming unit with a fixing member, the fixing unit including the fixing member configured to be brought into contact with each sheet supplied from the image forming unit and heat each sheet; a measuring unit configured to measure a temperature of the fixing member; and a control unit configured to instruct the fixing unit to start and stop a temperature increasing operation, and provide the image data to the image forming unit, wherein the control unit includes: a temperature drop rate calculating unit; a temperature rise rate predicting unit; and an instructing unit.

15 Claims, 14 Drawing Sheets

| TEMPERATURE RISE RATE REFERENCE VALUE $\Delta T^U_R$ | | SHEET TYPE | |
|---|---|---|---|
| | | REGULAR PAPER LESS THAN 90 g/m² | HEAVY PAPER 90 g/m² OR MORE |
| ENVIRONMENTAL TEMPERATURE | NORMAL TEMPERATURE 10°C OR HIGHER | HIGH SPEED | INTERMEDIATE SPEED |
| | LOW TEMPERATURE LOWER THAN 10°C | INTERMEDIATE SPEED | LOW SPEED |

IMAGE FORMING APPARATUS WITH FIXING MEMBER TEMPERATURE CONTROL

The entire disclosure of Japanese Patent Application No. 2014-046780 filed on Mar. 10, 2014 including description, claims, drawings, and abstract are incorporated herein by reference in its entirety.

BACKGROUND OF THE INVENTION

1. Field of the Invention

The present invention relates to an image forming apparatus, and more particularly, to temperature control on the fixing member of the image forming apparatus.

2. Description of the Related Art

Among image forming apparatuses, each of those forming toner images on sheets and thermally fixing the toner images, such as laser printers, facsimile machines, and copying machines, includes a fixing unit. The fixing unit is a functional unit that performs a fixing process on a supplied sheet, and includes a fixing member and a heater. The fixing member includes a rotator such as a roller or a belt, and transfers heat to a sheet by bringing the rotator into contact with the surface of the sheet. The heater is designed to heat the fixing member, and normally uses a halogen lamp or induction heating.

To further reduce the power consumption in such an image forming apparatus, a reduction in the power consumption by the fixing unit is effective. In practice, the electric power required for the fixing unit to perform an operation to continuously increase the temperature of the fixing member (hereinafter referred to as the "temperature increasing operation") and an operation to maintain the temperature at a constant level (hereinafter referred to as the "temperature adjusting operation") accounts for a large proportion of the power consumption by such a machine.

The following technique is known as a technique for reducing the power consumption by the fixing unit: "in an operation mode that does not require the fixing process, or while a sheet that does not require the fixing process is being supplied, the fixing unit is made to stop both the temperature increasing operation and the temperature adjusting operation". While these operations are suspended, the temperature of the fixing member drops. Therefore, in this technique, it is critical to accurately determine the time to cause the fixing unit to resume the temperature increasing operation. If the resumption of the temperature increasing operation is late, the temperature of the fixing member does not reach the value that should be maintained during the fixing process even when the time for the next fixing process has come. As a result, the thermal fixing of a toner image becomes insufficient, and the toner image is scratched, for example. Therefore, there is a possibility of a decrease in printing quality.

As techniques for accurately determining the time to resume a temperature increasing operation, those disclosed in JP 2012-128037 A and JP 2012-128189 A are known. By these techniques, the temperature rise curve of the fixing member is estimated in advance. The temperature rise curve is the curve that represents the relationship that is established between the time of the resumption of the temperature increasing operation by the fixing unit and the temperature of the fixing member at the time of the resumption when the following condition is satisfied: "by the time when the fixing unit thermally fixes a toner image, the temperature of the fixing member has reached the target value that should be maintained at that time". By the above techniques, the temperature of the fixing member is monitored while the temperature increasing operation of the fixing unit is suspended, and the temperature increasing operation of the fixing unit is resumed at the time when the point at the coordinates representing the combination of the current time and the temperature of the fixing member is located on the temperature rise curve.

JP 2012-128189 A also discloses the following technique. By this technique, the temperature of the fixing member is first measured while the temperature increasing operation of the fixing unit is suspended, and the curve indicating a temporal variation in the temperature of the fixing member, or the temperature drop curve, is estimated from the measured value of the temperature of the fixing member. The coordinates of the intersection point between the temperature rise curve and the temperature drop curve are then predicted, and the temperature increasing operation of the fixing unit is resumed at the time indicated by the intersection point.

By these techniques, the estimation of the temperature rise curve is based on an experiment or measurement that is carried out prior to actual printing operations. Specifically, in a case where the estimated shape of the temperature rise curve is approximated by a straight line, a predicted value of the temperature rise rate that is represented by the tilt of the straight line is determined through an experiment. JP 2012-128189 A also discloses a technique by which the temperature rise rate of the fixing member is measured at the time of activation of the image forming apparatus, and the measured value is set as a predicted value.

In recent years, there is an increasing demand for power saving features in electronic products in general. Image forming apparatuses are also expected to further reduce power consumption. To satisfy the demand, a further reduction in power consumption by the fixing unit is effective as described above.

So as to further reduce the power consumption by the fixing unit while preventing printing quality degradation due to insufficient thermal fixing, the accuracy of temperature rise curve estimation should be made even higher, and the temperature increasing operation should be resumed at a more accurate time.

By the techniques disclosed in JP 2012-128037 A and JP 2012-128189 A, however, it is difficult to further increase the accuracy of the temperature rise curve estimation. This is because the experiment and the like used in predicting the temperature rise rate do not reflect the state of the fixing unit that affects the amount of heat transferred to and from the fixing member, or the internal conditions of the fixing unit.

SUMMARY OF THE INVENTION

The present invention has been developed to solve the above problems, and an object thereof is to provide an image forming apparatus that can prevent printing quality degradation due to insufficient thermal fixing and further reduce the electric power consumed by the temperature increasing operation of the fixing unit. In the image forming apparatus, the state of the fixing unit at a time of actual printing is reflected in the prediction of the temperature rise rate of the fixing member, so that the accuracy of the prediction is increased.

To achieve the abovementioned object, according to an aspect, an image forming apparatus reflecting one aspect of the present invention comprises a sheet feeding unit, an image forming unit, a fixing unit, a measuring unit, and a control unit. The sheet feeding unit feeds sheets to the image forming unit one by one. The image forming unit forms a toner image based on image data, on each sheet supplied from the sheet feeding unit. The fixing unit includes a fixing member that comes into contact with each sheet sent from the image forming unit and heats each sheet. With the fixing member, the fixing unit thermally fixes the toner image formed on each sheet by the image forming unit. The measuring unit measures the temperature of the fixing member. The control unit instructs the fixing unit to start and stop a temperature increasing operation, and provides the image data to the image forming unit.

The control unit includes a temperature drop rate calculating unit, a temperature rise rate predicting unit, and an instructing unit. While the temperature of the fixing member is dropping due to a stop of the temperature increasing operation of the fixing unit, the temperature drop rate calculating unit calculates the temperature drop rate of the fixing member from the value measured by the measuring unit. From the temperature drop rate calculated by the temperature drop rate calculating unit, the temperature rise rate predicting unit predicts the temperature rise rate of the fixing member at the time when the fixing unit is made to resume the temperature increasing operation. Using the temperature rise rate predicted by the temperature rise rate predicting unit, the instructing unit determines the time to cause the fixing unit to resume the temperature increasing operation or the temperature of the fixing member on condition that "by the time when the fixing unit thermally fixes a toner image, the temperature of the fixing member has reached the target value that should be maintained at the time", and instructs the fixing unit to resume the temperature increasing operation at the determined time or at the time when the measured value of the measuring unit drops to the determined temperature.

The temperature drop rate calculating unit preferably estimates a temperature drop curve by using the calculated temperature drop rate. The instructing unit preferably estimates a temperature rise curve by using the temperature rise rate predicted by the temperature rise rate predicting unit. The "temperature drop curve" indicates a temporal variation in the temperature of the fixing member while the temperature of the fixing member is dropping due to a stop of the temperature increasing operation of the fixing unit. The "temperature rise curve" is the curve that represents the relationship that is established between the time of the resumption of the temperature increasing operation by the fixing unit and the temperature of the fixing member at the time of the resumption when the following condition is satisfied: "by the time when the fixing unit thermally fixes a toner image, the temperature of the fixing member has reached the target value that should be maintained at the time". The temperature drop curve and the temperature rise curve are preferably approximated by straight lines. Where these curves are estimated, the instructing unit preferably determines the time to cause the fixing unit to resume the temperature increasing operation or the temperature of the fixing member, using the coordinates of the intersection point between the temperature drop curve and the temperature rise curve.

Under the assumption that "the temperature increasing operation of the fixing unit remains suspended", the instructing unit preferably predicts, from the temperature drop curve, the temperature of the fixing member at the time when the fixing unit thermally fixes a toner image. If the predicted temperature is lower than the target value at which the temperature of the fixing member should be maintained at the time when the fixing unit thermally fixes a toner image, the instructing unit preferably determines the time to cause the fixing unit to resume the temperature increasing operation or the temperature of the fixing member.

While the temperature increasing operation of the fixing unit remains suspended, one sheet is fed to the fixing unit, and the temperature drop curve indicates that the temperature of the fixing unit at a first time that is earlier than the time at which the fixing unit ends the fixing process for the one sheet drops to a first temperature that should be maintained during the fixing process. In that case, the instructing unit preferably operates in the following manner. (1) If the first time is earlier than the second time indicated by the coordinates of the intersection point between the temperature drop curve and the temperature rise curve, or if the first temperature is higher than the second temperature indicated by the coordinates of the intersection point between the temperature drop curve and the temperature rise curve, the instructing unit preferably instructs the fixing unit to start a temperature adjusting operation at the first time. (2) If the first time is equal to or later than the second time, or if the first temperature is equal to or lower than the second temperature, the instructing unit preferably instructs the fixing unit to resume the temperature increasing operation at the second time.

The temperature rise rate predicting unit preferably predicts a higher temperature rise rate when the temperature drop rate calculated by the temperature drop rate calculating unit is lower. The temperature rise rate predicting unit preferably uses a calculation in predicting the temperature rise rate, the calculation being based on the assumption that the difference between the actual value of the temperature rise rate and the reference value for the temperature rise rate is proportional to the difference between the value of the temperature drop rate calculated by the temperature drop rate calculating unit and the reference value for the temperature drop rate.

The control unit preferably further includes an image analyzing unit. The image analyzing unit preferably analyzes image data, and creates toner amount information. The "toner amount information" indicates, for each sheet, the amount of toner necessary for the image forming unit to form a toner image based on the image data. Based on the toner amount information, the instructing unit preferably determines, for each sheet, the target value at which the temperature of the fixing member should be maintained at the time when the fixing unit thermally fixes a toner image.

Based on the toner amount information, the instructing unit preferably detects a boundary in a transition from a sheet requiring an amount of toner equal to or larger than a threshold value for forming a toner image, to a sheet requiring a smaller amount of toner than the threshold value for forming a toner image among the sheets. In this case, the instructing unit preferably instructs the fixing unit to stop the temperature increasing operation at the time when the fixing unit ends the fixing process for the sheet located immediately before the boundary. When the target value determined for the first sheet between two successive sheets among the sheets is lower than the target value determined for the next sheet by an allowable difference or more, the instructing unit preferably instructs the fixing unit to stop the temperature increasing operation at the time when the fixing unit ends the fixing process for the first sheet. For a sheet not having any target value determined therefor yet for a reason that any toner amount is not specified in the toner amount information, the instructing unit preferably determines that the allowable upper limit value of the temperature of the fixing member is the target value until the toner amount information is updated, the sheet being one of the sheets.

The image forming apparatus preferably further includes an environmental temperature measuring unit that measures the internal or ambient temperature of the fixing unit. In this case, to predict the temperature rise rate of the fixing unit, the temperature rise rate predicting unit preferably further uses the value measured by the environmental temperature measuring unit. To predict the temperature rise rate of the fixing unit, the temperature rise rate predicting unit preferably further uses the attributes of the sheet to be fed to the fixing unit. The "attributes" of the sheet are the characteristics of the sheet such as the material, the size, the thickness, and the weighing capacity of the sheet that affect the amount of heat to be absorbed from the fixing member when the sheet is in contact with the fixing member.

The fixing unit preferably further includes a pressing unit and a detecting unit. The pressing unit preferably presses a supplied sheet against the fixing member. The detecting unit preferably detects the temperature of the pressing unit. In this case, to predict the temperature rise rate of the fixing unit, the temperature rise rate predicting unit preferably further uses the value detected by the detecting unit.

The image forming apparatus preferably further includes a power supply unit that supplies the fixing unit with the power necessary for the temperature increasing operation. In this case, the instructing unit preferably causes the power supply unit to cut off the power supply to the fixing unit when instructing the fixing unit to stop the temperature increasing operation.

The fixing member is preferably movable between a first position in contact with the sheet traveling in the fixing unit and a second position not in contact with the sheet. In this case, the fixing unit preferably moves the fixing member to the second position when instructed to stop the temperature increasing operation by the instructing unit.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

[Outline of the Structure of an Image Forming Apparatus]

Figure 1:
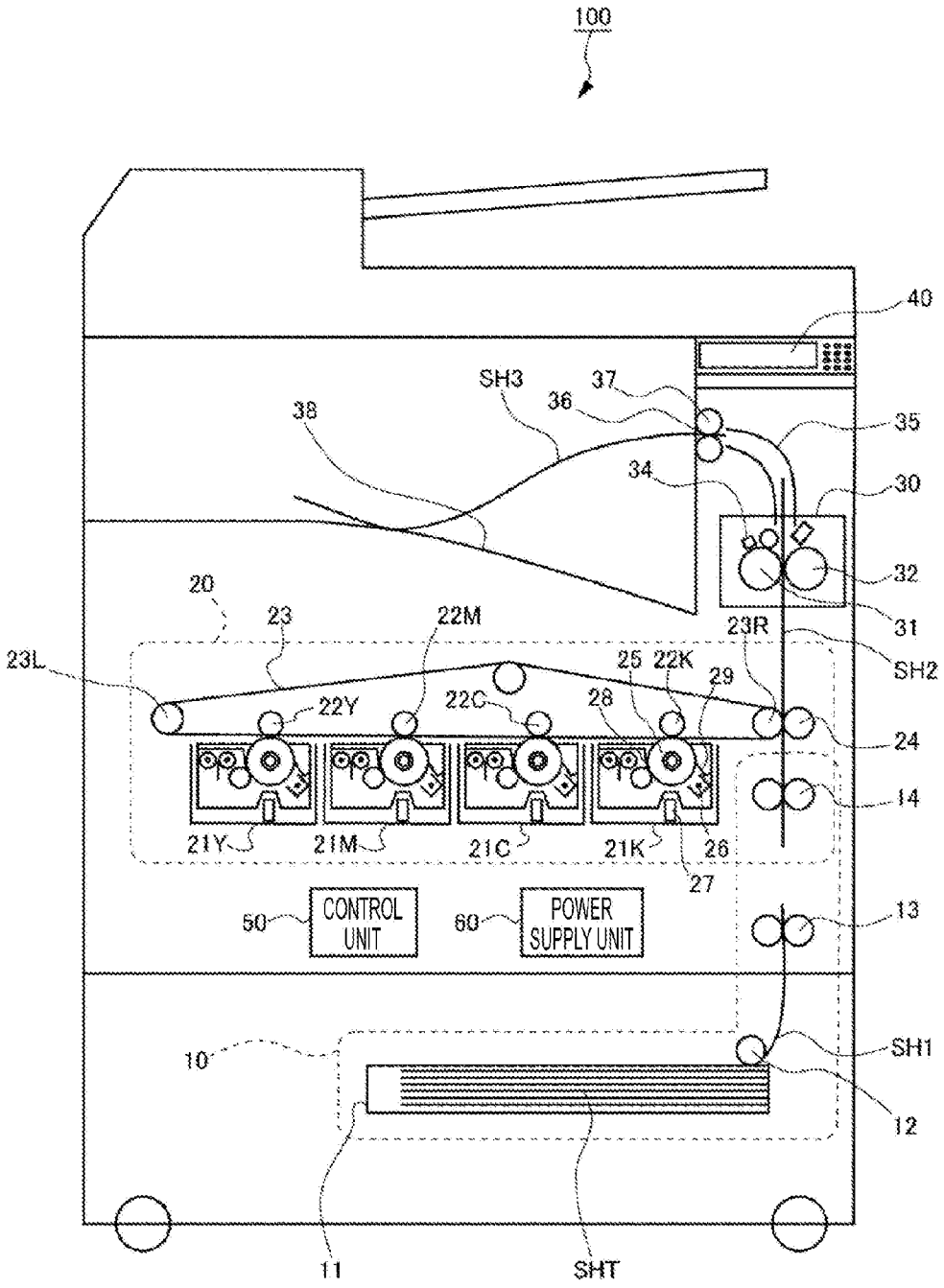
FIG. 1 is a schematic front view showing the structure of an image forming apparatus according to an embodiment of the present invention.

FIG. 1 is a schematic front view showing the structure of an image forming apparatus according to an embodiment of the present invention. FIG. 1 shows the internal components in the image forming apparatus 100 as if the front side of the housing were transparent.

As shown in FIG. 1, the image forming apparatus 100 is a color laser printer, for example, and includes a sheet feeding unit 10, an image forming unit 20, a fixing unit 30, an operating unit 40, a control unit 50, and a power supply unit 60. The sheet feeding unit 10 feeds sheets SHT to the image forming unit 20 one by one. On a sheet SH2 sent from the sheet feeding unit 10, the image forming unit 20 forms a toner image in the four colors of yellow (Y), magenta (M), cyan (C), and black (K) based on image data. The fixing unit 30 thermally fixes the toner image with a fixing member. The operating unit 40 includes push buttons or a touch panel, receives a print instruction through a user's operation of the push buttons or the touch panel, and transmits the information about the instruction to the control unit 50. The operating unit 40 is connected to a network through an external interface, receives a print request from another electronic device and the image data of the object to be printed, and then transfers the print request and the image data to the control unit 50. The control unit 50 is an electronic circuit mounted on a single substrate, instructs the other components in the image forming apparatus 100 to operate in an operation mode such as a running mode, a standby mode, or a sleep mode based on information supplied from the operating unit 40, and causes the respective components to perform processing in the operation mode. Specifically, the control unit 50 instructs the fixing unit 30 to start and stop a temperature increasing operation and a temperature adjusting operation, and provides image data to the image forming unit 20. The power supply unit 60 supplies a voltage/current of an appropriate value to each component in the image forming apparatus 100, using electrical power supplied from outside, such as a commercial AC power source. Specifically, in accordance with an instruction from the control unit 50, the power supply unit 60 supplies the fixing unit 30 with the power necessary for a temperature increasing operation and a temperature adjusting operation.

[Sheet Feeding Unit]

As shown in FIG. 1, the sheet feeding unit 10 includes a container tray 11, a feed roller 12, conveyance rollers 13, and timing rollers 14. The container tray 11 is placed in a lower portion of the image forming apparatus 100, and is capable of accommodating the sheets SHT. The material of the sheets SHT is paper, for example. The feed roller 12 feeds the sheet SH1 located at the top of those sheets SHT toward the conveyance rollers 13. The sheet SH1 is further conveyed to the timing rollers 14 by the conveyance rollers 13. The timing rollers 14 are normally at rest when the conveyance starts, and starts rotating in response to a drive signal supplied from the control unit 50. As a result, a sheet SH2 sent from the conveyance rollers 13 is conveyed from the timing rollers 14 to the image forming unit 20 at the time indicated by the drive signal.

[Image Forming Unit]

As shown in FIG. 1, the image forming unit 20 includes four imaging units 21Y, 21M, 21C, and 21K, four first transfer rollers 22Y, 22M, 22C, and 22K, an intermediate transfer belt 23, and a second transfer roller 24. The imaging units 21Y, 21M, 21C, and 21K are arranged at predetermined intervals in the horizontal direction. Each of the first transfer rollers 22Y, 22M, 22C, and 22K is placed to face one of the imaging units 21Y, 21M, 21C, and 21K in the vertical direction. The intermediate transfer belt 23 is supported by two rollers 23L and 23R, and rotates with these two rollers 23L and 23R. Of the intermediate transfer belt 23, the portion maintained straight in the horizontal direction passes between the imaging units 21Y, 21M, 21C, and 21K and the first transfer rollers 22Y, 22M, 22C, and 22K. When the intermediate transfer belt 23 rotates, its surface sequentially comes into contact with the first transfer rollers 22Y, 22M, 22C, and 22K. The second transfer roller 24 is placed in parallel with one roller 23R of the two rollers supporting the intermediate transfer belt 23, and the intermediate transfer belt 23 is interposed between the second transfer roller 24 and the roller 23R. The sheet SH2 sent from the timing rollers 14 is made to pass through the contact portion, or a nip, between the intermediate transfer belt 23 and the second transfer roller 24.

The four imaging units 21Y, 21M, 21C, and 21K have the same structures, and each of them includes a photosensitive drum 25, a charging unit 26, an exposing unit 27, a developing unit 28, a cleaner 29, and an eraser lamp (not shown in FIG. 1). The outer circumference of the photosensitive drum 25 is surrounded by the charging unit 26 and other components. The charging unit 26 charges uniformly the facing portion of the outer peripheral surface of the photosensitive drum 25. The exposing unit 27 includes a light emitting element and a lens. The light emitting element may be a laser diode, for example. Using those components, the exposing unit 27 exposes the charged portion of the outer peripheral surface of the photosensitive drum 25. At this point, the region exposed to light is neutralized. The shape of the region is determined by a drive signal from the control unit 50. The region remains as an electrostatic latent image on the outer peripheral surface. The developing unit 28 then performs development by superimposing the toners of the colors allotted to the imaging units 21Y, 21M, 21C, and 21K on the electrostatic latent image. The cleaner 29 removes the remaining toner from a portion of the outer peripheral surface of the photosensitive drum 25 immediately after the portion has come into contact with the intermediate transfer belt 23. The eraser lamp performs neutralization by emitting light uniformly to the facing portion of the outer peripheral surface of the photosensitive drum 25.

Since a first transfer voltage is applied to the first transfer rollers 22Y, 22M, 22C, and 22K, an electric field is generated between the photosensitive drums 25 and the first transfer rollers 22Y, 22M, 22C, and 22K, with the intermediate transfer belt 23 being interposed therein. This electric field transfers toner images from the photosensitive drums 25 to the surface of the intermediate transfer belt 23. The four imaging units 21Y, 21M, 21C, and 21K perform respective imaging operations at different times in synchronization with the rotation of the intermediate transfer belt 23. As a result, toner images in the respective colors are sequentially transferred from the photosensitive drums 25 of the imaging units 21Y, 21M, 21C, and 21K, and are superimposed on one another at the same position on the surface of the intermediate transfer belt 23. In this manner, a color toner image is formed on the surface of the intermediate transfer belt 23.

Since a second transfer voltage is applied to the second transfer roller 24, an electric field is generated between the second transfer roller 24 and the intermediate transfer belt 23. When the sheet SH2 passes through the nip between the intermediate transfer belt 23 and the second transfer roller 24, this electric field transfers the color toner image from the intermediate transfer belt 23 to the surface of the sheet SH2. The second transfer roller 24 then sends the sheet SH2 to the fixing unit 30.

[Fixing Unit]

The fixing unit 30 includes a fixing roller 31, a pressure roller 32, a temperature sensor 34, and an environmental temperature measuring unit (not shown in FIG. 1). The fixing roller 31 and the pressure roller 32 are placed in parallel with each other, and are in contact with each other. The sheet SH2 sent from the image forming unit 20 is made to pass through the contact portion, or the fixing nip, between the fixing roller 31 and the pressure roller 32. The temperature sensor 34 is placed near the center portion of the fixing roller 31 in the axial direction, and the environmental temperature measuring unit is placed inside or near the fixing unit 30.

The fixing roller 31 is a rotator to be used as the fixing member, and the surface of the fixing roller 31 is in contact with the surface of the sheet SH2 passing through the fixing nip while the fixing roller 31 is rotating. The fixing roller 31 includes a halogen lamp as a heater, and heat generated from the halogen lamp to the surface of the fixing roller 31 is transferred to the portion of the sheet SH2 in contact with the surface of the fixing roller 31. Meanwhile, the pressure roller 32 applies pressure to the contact portion of the sheet SH2, and presses the sheet SH2 against the fixing roller 31. Of the sheet SH2, the portion on which the toner image is formed by the image forming unit 20 is made to pass through the fixing nip. The toner image is then fixed onto the surface of the sheet SH2 by virtue of the heat from the fixing roller 31 and the pressure from the pressure roller 32.

The temperature sensor 34 includes a thermopile, and measures the temperature of the surface of the fixing roller 31 (hereinafter referred to simply as the "temperature of the fixing roller 31") with the thermopile. The environmental temperature measuring unit includes a thermistor, and measures the internal or ambient temperature of the fixing unit 30 with the thermistor. The control unit 50 is notified of the values of those measured temperatures, and uses these values in controlling generation of heat from the halogen lamp. Under the control of the control unit 50, the fixing unit 30 performs a temperature increasing operation or a temperature adjusting operation.

After subjected to the fixing process at the fixing unit 30, the sheet SH2 is guided from the top portion of the fixing unit 30 toward a discharge opening 36 by a guide panel 35. A pair of discharge rollers 37 are placed in front of the discharge opening 36, and discharge a sheet SH3 onto a discharge tray 38 on the outside.

[Control Unit]

Figure 2:
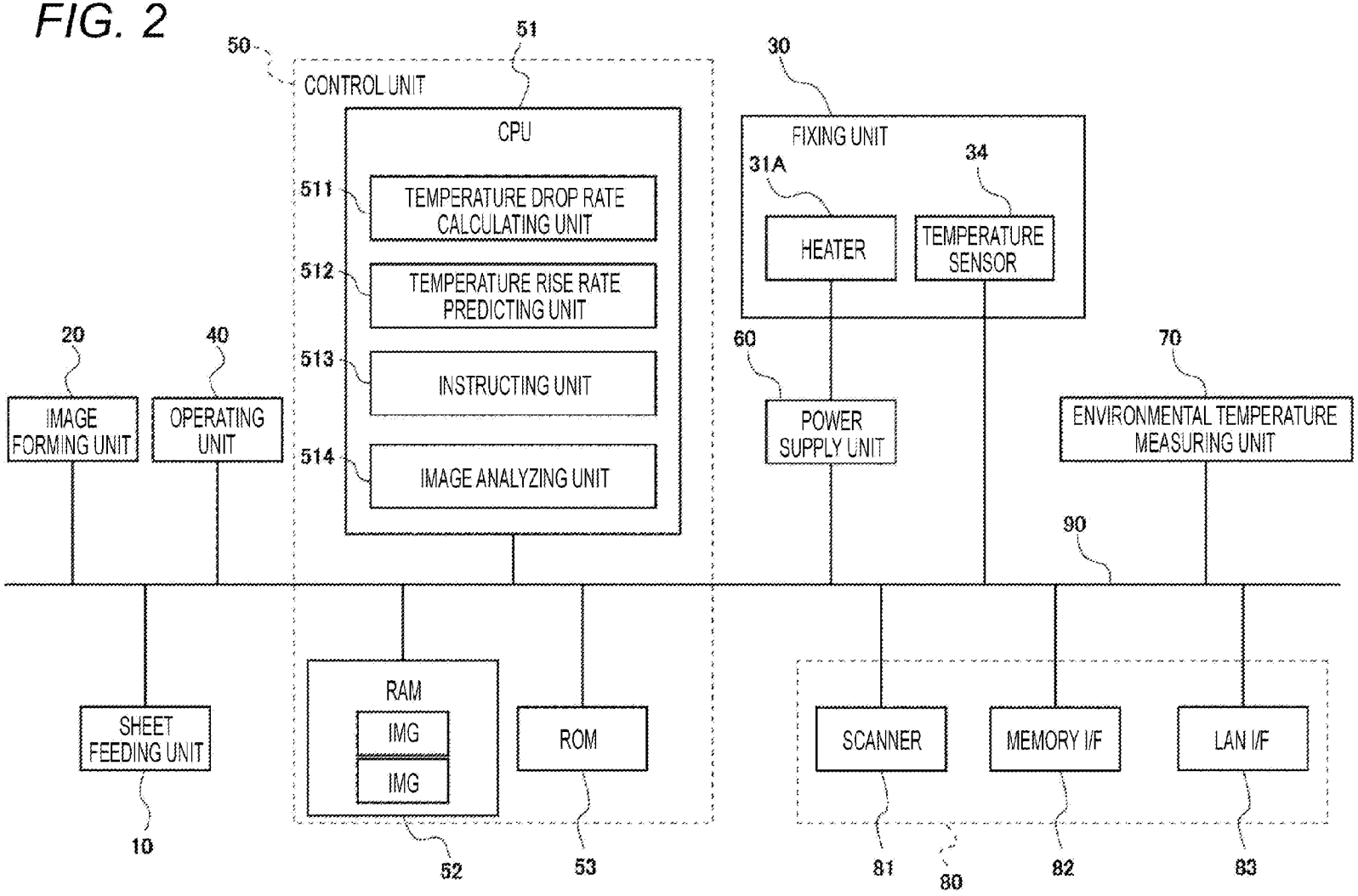
FIG. 2 is a block diagram showing the configuration of the control system of the image forming apparatus shown in FIG. 1.

FIG. 2 is a block diagram showing the configuration of the control system of the image forming apparatus 100. As shown in FIG. 2, in this system, the functional units 10, 20, 30, 40, 50, 60, 70, and 80 in the image forming apparatus 100 are connected to one another via a bus 90 in a communicable manner. The control unit 50 is the primary component of this system, and includes a CPU 51, a RAM 52, and a ROM 53.

The CPU 51 controls the other functional units in accordance with firmware. Specifically, the CPU 51 receives the values of temperatures measured by the temperature sensor 34 in the fixing unit 30 and the environmental temperature measuring unit 70, and uses these values in controlling the temperature of the fixing roller 31. When causing the fixing unit 30 to start a temperature increasing operation or a temperature adjusting operation, the CPU 51 causes the power supply unit 60 to start supplying power to a heater 31A. When causing the fixing unit 30 to suspend the temperature increasing operation or the temperature adjusting operation, the CPU 51 causes the power supply unit 60 to cut off the power supply.

The RAM 52 provides the CPU 51 with the work area for executing the firmware. Specifically, every time the operating unit 40 receives a print request, the RAM 52 receives, through an external interface 80, the image data IMG and the page description language (PDL) of the object to be printed, and stores the image data IMG and the page description language. The PDL specifies the contents of the requested printing, or more specifically, the format in which the image represented by the image data IMG is to be printed. The external interface (I/F) 80 is the functional unit for receiving data from a user or an external network (LAN), and includes a scanner 81, a memory interface (I/F) 82, and a LAN interface (I/F) 83. The scanner 81 emits light to the surface of a document by using an optical device mounted on the image forming apparatus 100, reads text, a figure, or a picture from the intensity distribution of the reflected light, and converts the text, the figure, or the picture into image data. The memory interface 82 acquires image data from an external semiconductor memory device or an external hard disk drive (HDD) attached to the image forming apparatus 100 via an external bus such as a USB. The LAN interface 83 is connected to an external LAN in a wired or wireless manner, and receives image data from a PC or the like in the LAN.

The ROM 53 includes an unwritable semiconductor memory device and a rewritable semiconductor memory device such as an EEPROM. The former stores the firmware, and the latter provides the CPU 51 with the storage area for saving environment variables and the like. Specifically, the ROM 53 stores respective reference values for the temperature rise rate and the temperature drop rate at the fixing roller 31.

[Temperature Control To Be Performed by the Control Unit on the Fixing Roller]

—Functional Units to be Used in Temperature Control—

As shown in FIG. 2, the control unit 50 includes a temperature drop rate calculating unit 511, a temperature rise rate predicting unit 512, an instructing unit 513, and an image analyzing unit 514. These functional units 511 to 514 are realized by the CPU 51 executing the firmware for controlling the temperature of the fixing roller 31.

While the temperature of the fixing roller 31 is dropping due to a stop of either a temperature increasing operation or a temperature adjusting operation (hereinafter referred to as the "temperature increasing operation or the like") of the fixing unit 30, the temperature drop rate calculating unit 511 repeatedly receives a measured value of the temperature of the fixing roller 31 from the temperature sensor 34, and calculates the temperature drop rate of the fixing roller 31 from these measured values. Using the calculated temperature drop rate, the temperature drop rate calculating unit 511 further estimates a variation of the temperature of the fixing roller 31 with time during the suspended period of the temperature increasing operation or the like, or estimates a temperature drop curve.

From the temperature drop rate calculated by the temperature drop rate calculating unit 511, the temperature rise rate predicting unit 512 predicts the temperature rise rate of the fixing roller 31 at the time when the fixing unit 30 is made to resume the temperature increasing operation. The temperature rise rate predicting unit 512 predicts a higher temperature rise rate when the calculated temperature drop rate is lower. Specifically, the temperature rise rate predicting unit 512 reads the respective reference values for the temperature drop rate and the temperature rise rate from the ROM 53, determines a value by subtracting each reference value from the temperature drop rate calculated by the temperature drop rate calculating unit 511, and determines a predicted value of the temperature rise rate on the assumption that "the difference between the actual value of the temperature rise rate and its reference value is proportional to the determined value". The proportionality constant at this point is set at "−1", for example. The process for predicting a temperature rise rate will be described later in greater detail.

The instructing unit 513 instructs the fixing unit 30 to start and stop the temperature increasing operation or the like. Specifically, the instructing unit 513 first determines a target value for each sheet in controlling the temperature of the fixing roller 31 during the fixing process. Based on the target value, the instructing unit 513 determines the time to cause the fixing unit 30 to start or stop the temperature increasing operation or the like. The instructing unit 513 further issues an instruction to the power supply unit 60 every time a determined time has come, and causes the power supply unit 60 to start or stop the power supply to the heater 31A in the fixing unit 30.

The target value in temperature control to be performed on the fixing roller 31 during the fixing process is a sufficiently high temperature required for the fixing roller 31 to have to thermally fix the toner image formed on the sheet being subjected to the fixing process, and depends mainly on the amount of the toner forming the toner image. The instructing unit 513 determines the target value based on the amount of the toner required in forming a toner image on each sheet. As for a sheet that requires a smaller amount of toner than a threshold value, the instructing unit 513 regards the sheet as "substantially blank", and does not set any target value for the sheet.

The instructing unit 513 determines the time to cause the fixing unit 30 to stop the temperature increasing operation or the like in the following manner. The instructing unit 513 first identifies a sheet on which any target value has not been set because the amount of toner required for forming a toner image is smaller than the threshold value, or identifies a sheet regarded as "substantially blank". The instructing unit 513 then detects the boundary as the transition from a sheet requiring a larger amount of toner than the threshold value for forming a toner image, to a sheet regarded as substantially blank. The instructing unit 513 further determines that the time for the fixing unit 30 to end the fixing process for the sheet located immediately before the boundary is the time for the fixing unit 30 to end the temperature increasing operation or the like.

While the fixing unit 30 is performing neither the temperature increasing operation nor the temperature adjusting operation, the instructing unit 513 determines whether to cause the fixing unit 30 to resume the temperature increasing operation in the following manner. Under the assumption that "the temperature increasing operation or the like of the fixing unit 30 remains suspended", the instructing unit 513 first predicts, from the temperature drop curve estimated by the temperature drop rate calculating unit 511, the temperature of the fixing roller 31 at the time when the next sheet to which a toner image is to be thermally fixed starts passing through the fixing unit 30. If the predicted temperature is lower than the target value for the next sheet to which a toner image is to be thermally fixed, the instructing unit 513 determines that "the fixing unit 30 should be caused to resume the temperature increasing operation".

In this case, the instructing unit 513 determines the time to cause the fixing unit 30 to resume the temperature increasing operation in the following manner. The instructing unit 513 first estimates the temperature rise curve of the fixing roller 31, using the temperature rise rate predicted by the temperature rise rate predicting unit 512. The "temperature rise curve" is the curve that represents the relationship that is established between the time of the resumption of the temperature increasing operation by the fixing unit 30 and the temperature of the fixing roller 31 at the time of the resumption when the following condition is satisfied: "by the time when the fixing unit 30 thermally fixes a toner image, the temperature of the fixing roller 31 has reached the target value that should be maintained at that time". The instructing unit 513 then determines the intersection point between the temperature rise curve and the temperature drop curve estimated by the temperature drop rate calculating unit 511, and determines the time indicated by the coordinates of the intersection point to be the time for the fixing unit 30 to resume the temperature increasing operation.

The image analyzing unit 514 analyzes the image data IMG stored in the RAM 52, and creates toner amount information. The "toner amount information" indicates, for each sheet, the amount of toner necessary for the image forming unit 20 to form a toner image based on the image data IMG. The image analyzing unit 514 analyzes the image represented by the image data IMG, or analyzes the PDL accompanying the image data IMG, and determines the toner amount to be indicated by the toner amount information in the manner described below.

(1) For each sheet, the image analyzing unit 514 first determines whether there is a toner image to be formed on the sheet, and, if there is one or more toner images, determines whether the total area of those toner images exceeds the lower limit value. If there are no toner images to be formed, or if the total area of toner images does not exceed the lower limit value, the image analyzing unit 514 regards the sheet as a "sheet that is to be output as a substantially blank sheet", and determines that the amount of toner to be used for the sheet is "a smaller value than the threshold value set by the instructing unit 513".

(2) The image analyzing unit 514 then determines whether the toner images on a sheet having a larger total toner image area than the lower limit value are color images. If the toner images include a color portion, the image analyzing unit 514 determines that the amount of toner to be used for the sheet is "a value necessary for forming a color toner image".

(3) As for a sheet on which only monochrome toner images are to be formed, the image analyzing unit 514 determines whether these toner images include a picture. If the toner images include a picture, the image analyzing unit 514 determines that the amount of toner to be used for the sheet is "a value necessary for forming a toner image of a monochrome picture".

(4) As for a sheet on which only toner images of objects other than pictures such as monochrome text or monochrome figures are to be formed, the image analyzing unit 514 determines whether these toner images include a portion with toner densities of 100%, 0%, and an intermediate value between 0% and 100%. If the toner images include such a portion, the image analyzing unit 514 determines that the amount of toner to be used for the sheet is "a value necessary for forming a toner image of a monochrome picture". If the toner images do not include such a portion, the image analyzing unit 514 determines that the amount of toner to be used for the sheet is "a value necessary for forming a monochrome binary toner image".

The image analyzing unit 514 writes the toner amount thus determined for each sheet into the toner amount information, and transmits the toner amount information to the instructing unit 513. Based on the toner amount information, the instructing unit 513 determines, for each sheet, the target value at which the temperature of the fixing roller 31 should be maintained at the time when the fixing unit 30 thermally fixes a toner image. Specifically, (1) any target value is not set for a sheet for which the toner amount information indicates a smaller toner amount than the threshold value; (2) a target value that is a sufficiently high temperature for thermally fixing a color toner image, such as 190° C., is set for a sheet for which the toner amount information indicates a value necessary for forming a color toner image; (3) a target value that is a sufficiently high temperature for thermally fixing a toner image of a monochrome picture, such as 170° C., is set for a sheet for which the toner amount information indicates a value necessary for forming a toner image of a monochrome picture; and (4) a target value that is a sufficiently low temperature for thermally fixing a monochrome binary toner image, such as 150° C., is set for a sheet for which the toner amount information indicates a value necessary for forming a monochrome binary toner image.

—Details of the Temperature Control—

Figure 3:
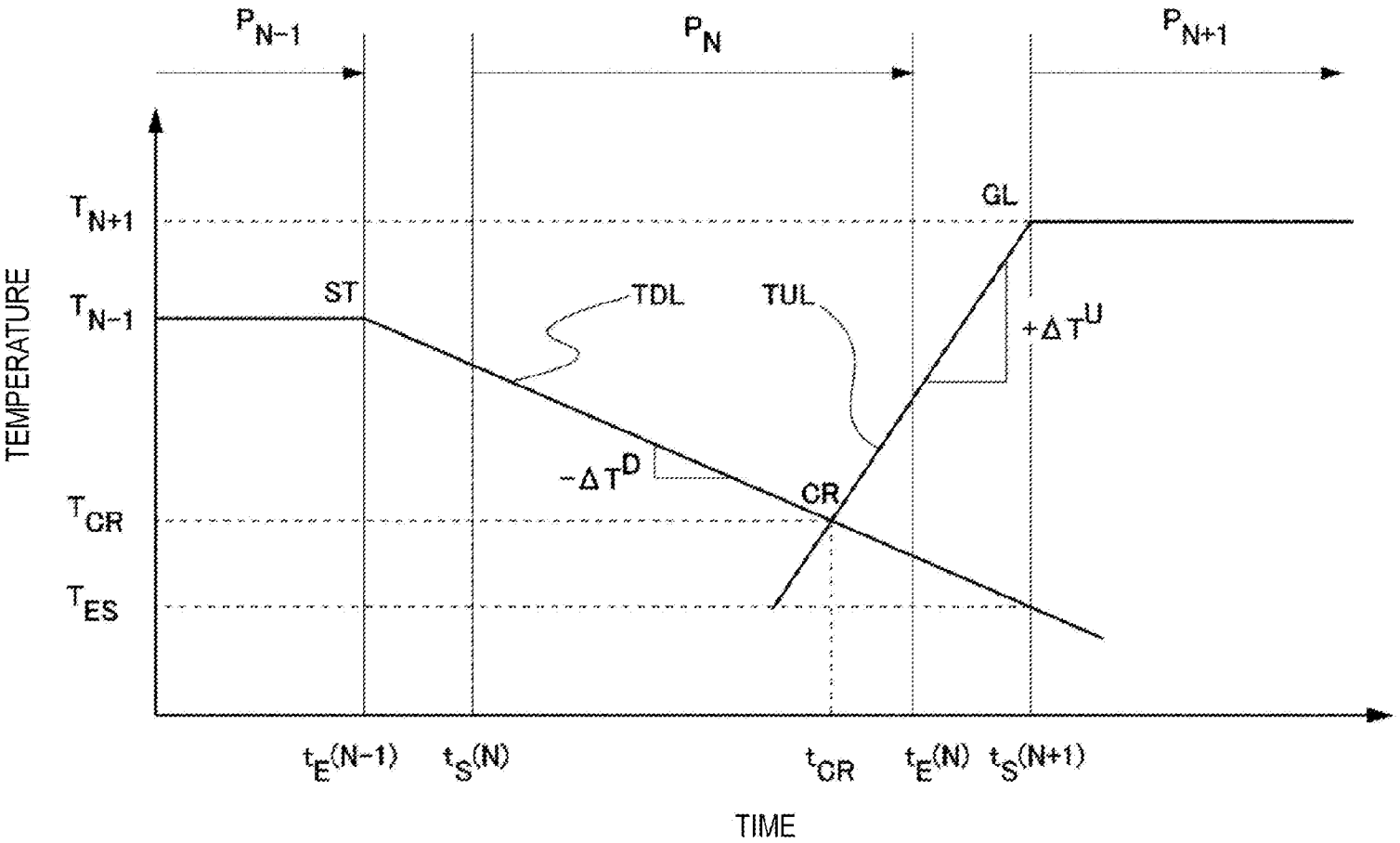
FIG. 3 is a graph showing an example of a temporal variation in the temperature of the fixing member shown in FIG. 1.

FIG. 3 is a graph showing an example of a variation in the temperature of the fixing roller 31 with time. As shown in FIG. 3, in three periods $P_{N-1}$, $P_N$, and $P_{N+1}$, the (N−1)th sheet, the Nth sheet, and the (N+1)th sheet are sequentially fed to the fixing unit 30. The character N represents an integer of 2 or greater.

FIG. 3 shows a case based on the assumption that "the Nth sheet differs from the (N−1)th sheet located immediately before the Nth sheet and the (N+1)th sheet located immediately after the Nth sheet, and is to be output as a substantially blank sheet". In this case, the toner amount information created for the Nth sheet by the image analyzing unit 514 indicates a smaller toner amount than the threshold value. Therefore, the instructing unit 513 determines target values $T_{N-1}$ and $T_{N+1}$ for the (N−1)th sheet and the (N+1)th sheet, but does not determine any target value for the Nth sheet.

Not having determined any target value for the Nth sheet, the instructing unit 513 causes the fixing unit 30 to stop the temperature increasing operation or the like at the time when the feeding of the (N−1)th sheet to the fixing unit 30 is completed, or at the end time $t_E$(N−1) of the fixing process for the sheet. As a result, after the end time $t_E(N-1)$, the temperature of the fixing roller 31 drops. After the time $t_S(N)$ when the feeding of the Nth sheet to the fixing unit 30 is started, the temperature of the fixing roller 31 continues to drop.

While the temperature increasing operation or the like of the fixing unit 30 remains suspended, the temperature drop rate calculating unit 511 repeatedly receives a measured value of the temperature of the fixing roller 31 from the temperature sensor 34, and calculates the temperature drop rate $-\Delta T^D$ ($\Delta T^D>0$) of the fixing roller 31 from these measured values. Using the temperature drop rate $-\Delta T^D$, the temperature drop rate calculating unit 511 further estimates the temperature drop curve of the fixing roller 31 after the end time $t_E(N-1)$ of the fixing process for the (N−1)th sheet. This temperature drop curve is approximated by the straight line TDL that has the calculated temperature drop rate $-\Delta T^D$ as its tilt and passes through the point ST at the coordinates representing the combination of the target value $T_{N-1}$ for the (N−1)th sheet and the time $t_E(N-1)$.

From the straight line TDL approximating the temperature drop curve estimated by the temperature drop rate calculating unit 511, the following phenomenon is predicted: "if the temperature increasing operation or the like of the fixing unit 30 remains suspended, the temperature of the fixing roller 31 drops to a value $T_{ES}$ by the time $t_S(N+1)$ when the feeding of the (N+1)th sheet to the fixing unit 30 is started". For example, in a case where the target value $T_{N-1}$ for the (N−1)th sheet is 170° C., and the time elapsing from the end time $t_E(N-1)$ of the fixing process for the (N−1)th sheet to the start time $t_S(N+1)$ of the fixing process for the (N+1)th sheet is two seconds, the predicted value $T_{ES}$ of the temperature of the fixing roller 31 at the time $t_S(N+1)$ is 154° C. if the calculated value of the temperature drop rate is −8° C./sec., and is 146° C. if the calculated value of the temperature drop rate is −12° C./sec. Therefore, in a case where the target value $T_{N+1}$ for the (N+1)th sheet is 150° C., the predicted value $T_{ES}$=154° C. exceeds the target value $T_{N+1}$=150° C. if the calculated value of the temperature drop rate is −8° C./sec., and the predicted value $T_{ES}$=146° C. is lower than the target value $T_{N+1}$=150° C. if the calculated value of the temperature drop rate is −12° C./sec.

As long as the predicted value $T_{ES}$ is equal to or higher than the target value $T_{N+1}$, the instructing unit 513 causes the fixing unit 30 to keep the temperature increasing operation or the like suspended. If the predicted value $T_{ES}$ becomes lower than the target value $T_{N+1}$, on the other hand, the instructing unit 513 determines that "the fixing unit 30 should be made to resume the temperature increasing operation", and predicts a temperature rise curve of the fixing roller 31. This temperature rise curve is approximated by the straight line TUL that has the predicted value $+\Delta T^U$ ($\Delta T^U>0$) of the temperature rise rate of the fixing roller 31 as its tilt, and passes through the point GL at the coordinates representing the combination of the target value $T_{N+1}$ for the (N+1)th sheet and the start time $t_S(N+1)$ of the feeding of the (N+1)th sheet.

The instructing unit 513 then determines the intersection point CR between the temperature rise curve TUL and the temperature drop curve TDL, and causes the fixing unit 30 to resume the temperature increasing operation at the time $t_{CR}$ indicated by the coordinates of the intersection point CR. For example, in a case where the target value $T_{N-1}$ for the (N−1)th sheet is 150° C., the target value $T_{N+1}$ for the (N+1)th sheet is 170° C., the time $\Delta t=t_S(N+1)-t_E(N-1)$ elapsing from the end time $t_E(N-1)$ of the fixing process for the (N−1)th sheet to the start time $t_S(N+1)$ of the fixing process for the (N+1)th sheet is four seconds, the calculated value $-\Delta T^D$ of the temperature drop rate is −12° C./sec., and the predicted value $+\Delta T^U$ of the temperature rise rate is +15° C./sec., the time $t_{CR}$ indicated by the coordinates of the intersection point CR is expressed by the following equation: $t_{CR}=t_E(N-1)+(\Delta T^U\times\Delta t-(T_{N+1}-T_{N-1}))/(\Delta T^D+\Delta T^U)=t_E(N-1)+(15\times4-(170-150))/(12+15)=t_E(N-1)+1.5$ seconds. That is, the resumption time $t_{CR}$ of the temperature increasing operation is set at the time 1.5 seconds after the end time $t_E(N-1)$ of the fixing process for the (N−1) th sheet. After the resumption of the temperature increasing operation, the temperature of the fixing roller 31 rises along the temperature rise curve TUL from the value $T_{CR}$ at the intersection point CR, and reaches the target value $T_{N+1}$ for the (N+1)th sheet by the start time $t_S(N+1)$ of the fixing process for the (N+1)th sheet.

—Details of Temperature Rise Rate Prediction—

When predicting a temperature rise rate, the temperature rise rate predicting unit 512 first reads the respective reference values for a temperature rise rate and a temperature drop rate from the ROM 53. These reference values are determined, from an experiment or measurement conducted prior to actual printing operations, for values of various parameters on which both rates depend, such as sheet attributes including material, size, thickness, weighing capacity, operation modes of the image forming apparatus 100, and environmental temperatures. These reference values are specified for respective combinations of parameter values in tables stored in the ROM 53.

Figures 4A, 4B:
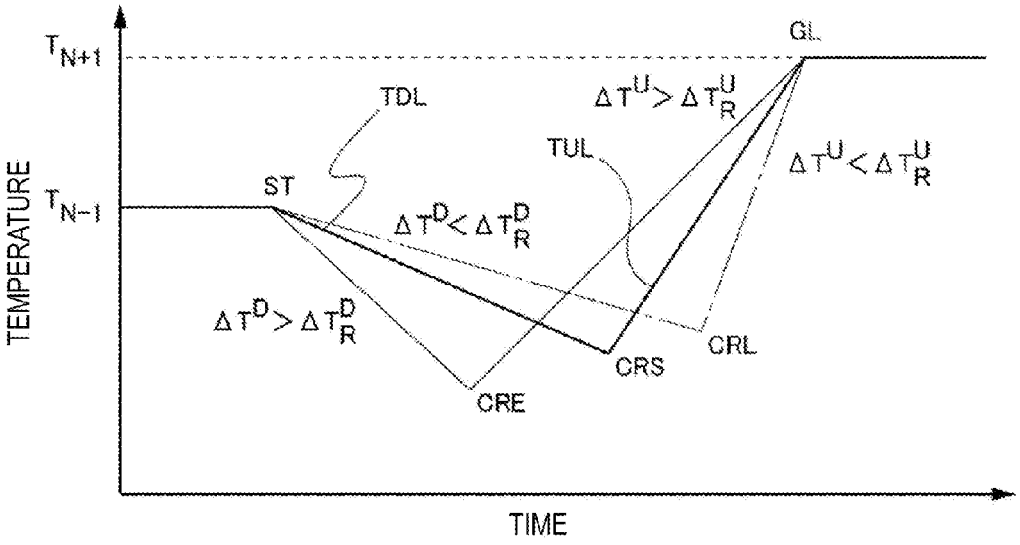
FIG. 4A is an example of a table that specifies reference values for temperature rise rates for respective combinations of types of sheets and values of environmental temperatures.
FIG. 4B is a graph schematically showing the relationship between a calculated value of a temperature drop rate and a predicted value of a temperature rise rate.

FIG. 4A is an example of a table that specifies reference values $\Delta T^U_R$ for temperature rise rates for respective combinations of types of sheets and values of environmental temperatures. Although not shown in FIG. 4A, reference values $\Delta T^D_R$ for temperature drop rates are also specified for respective combinations of types of sheets and values of environmental temperatures in a similar table.

As shown in FIG. 4A, the types of sheets are classified into the two types: "regular paper" having a lower weighing capacity than 90 g/m$^2$, and "heavy paper" having a weighting capacity equal to or higher than 90 g/m$^2$. Environmental temperatures, or internal or ambient temperatures of the fixing unit 30, are classified into the two types: "normal temperature", which is 10° C. or higher, and "low temperature", which is lower than 10° C. In this case, there are four combinations of values, such as "regular paper" and "normal temperature", between the types of sheets and the environmental temperatures. In FIG. 4A, the reference value $\Delta T^U_R$ for the temperature rise rate for each of those combinations is set at one of the three types of "high speed", "intermediate speed", and "low speed". Specific numerical values of the respective types are determined through experiments, and are several degrees C./sec to tens of degrees C./sec., for example. For example, for the combination of "regular paper" and "normal temperature", the reference value $\Delta T^U_R$ for the temperature rise rate is set at the maximum value, which is "high speed". For the combination of "heavy paper" and "low temperature", the reference value $\Delta T^U_R$ for the temperature rise rate is set at the minimum value, which is "low speed". These can be predicted from the facts that it is difficult for a sheet having a low weighing capacity to absorb heat from the fixing roller 31, and it is difficult for the fixing roller 31 to release heat at a high environmental temperature.

The temperature rise rate predicting unit 512 searches these tables for the reference value for the temperature drop rate and the reference value for the temperature rise rate in accordance with the actual operating conditions of the image forming apparatus 100. Specifically, prior to the search, the temperature rise rate predicting unit 512 acquires, from the components in the image forming apparatus 100, the values indicating the actual operating conditions of the components in the image forming apparatus 100, with respect to the respective parameters in the tables. For example, the sheet attribute defined by a print request is read from the operating unit 40, and the measured value of the internal or ambient temperature of the fixing unit 30 is received from the environmental temperature measuring unit 70. At the time of the actual search, the temperature rise rate predicting unit 512 reads, from among the reference values for both rates specified in the tables, the reference values associated with the combination of the values of the parameters obtained in advance.

The temperature rise rate predicting unit 512 then calculates a predicted value $\Delta T^U$ of the temperature rise rate from the reference values $\Delta T^U_R$ and $\Delta T^U_R$ for both rates read from the ROM 53 and the temperature drop rate $\Delta T^D$ calculated by the temperature drop rate calculating unit 511. The temperature rise rate predicting unit 512 first determines a difference $\Delta T^D-\Delta T^D_R$ by subtracting the reference value $\Delta T^D_R$ for the temperature drop rate from the temperature drop rate $\Delta T^D$ calculated by the temperature drop rate calculating unit 511. The temperature rise rate predicting unit 512 then determines the predicted value $\Delta T^U$ of the temperature rise rate on the assumption that "the difference $\Delta T^D-\Delta T^D_R$ is proportional to the difference between the actual value of the temperature rise rate and the reference value $\Delta T^U_R$". Specifically, the predicted value $\Delta T^U$ is calculated according to the following equation in which the proportionality coefficient is "−1": $\Delta T^U=\Delta T^U_R-(\Delta T^D-\Delta T^D_R)$. Accordingly, if the calculated value $\Delta T^D$ of the temperature drop rate is smaller than the reference value $\Delta T^D_R$, the predicted value $\Delta T^U$ of the temperature rise rate is greater than the reference value $\Delta T^U_R$. If the calculated value $\Delta T^D$ of the temperature drop rate is greater than the reference value $\Delta T^D_R$, the predicted value $\Delta T^U$ of the temperature rise rate is smaller than the reference value $\Delta T^U_R$.

The calculation by the temperature rise rate predicting unit 512 is aimed at compensating for the difference between the actual operating conditions of the fixing unit 30 and the operating conditions at the time of the experiment conducted to determine the reference values. Actually, as shown in FIG. 4A, a table normally specifies one reference value for a relatively wide range of parameter values. However, if the parameter values belonging to the same range defined in a table vary, the specific values of the temperature rise rates corresponding to those parameter values also vary. Therefore, the actual value of the temperature rise rate deviates from the reference value due to the difference between the actual operating conditions of the fixing unit 30 and the operating conditions at the time of the experiment conducted to determine the reference value.

The proportional relationship between the deviations from the reference values for both rates with which the above described calculation is performed by the temperature rise rate predicting unit 512 is based on the following assumption. Since the calculated value of the temperature drop rate reflects the actual variation of the temperature of the fixing roller 31 measured by the temperature sensor 34, the correlation described below is seen between the deviations from the reference values for both rates.

FIG. 4B is a graph schematically showing the relationship between the calculated value $\Delta T^D$ of the temperature drop rate and the predicted value $\Delta T^U$ of the temperature rise rate. In FIG. 4B, the tilt of the thick solid line represents the reference value $-\Delta T^D_R$ of the temperature drop rate and the reference value $+\Delta T^D_R$ of the temperature rise rate.

If the difference $\Delta T^D-\Delta T^D_R$ between the calculated value of the temperature drop rate and the reference value is a positive value, the tilt of the temperature drop curve TDL is greater than that of the thick solid line as indicated by the thin solid line in FIG. 4B. That is, in the actual state of the fixing unit 30, heat can be more easily released from the fixing roller 31 than in the state where the reference value for the temperature drop rate was determined. Accordingly, when the fixing unit 30 is made to resume the temperature increasing operation, a temperature rise is more difficult in the actual state of the fixing roller 31 than in the state where the reference value for the temperature rise rate was determined. Thus, the temperature rise rate is predicted to be lower than the reference value: $\Delta T^U<\Delta T^U_R$.

If the difference $\Delta T^D-\Delta T^D_R$ between the calculated value of the temperature drop rate and the reference value is a negative value, the tilt of the temperature drop curve TDL is smaller than that of the thick solid line as indicated by the dot-and-dash line in FIG. 4B. That is, in the actual state of the fixing unit 30, it is more difficult to release heat from the fixing roller 31 than in the state where the reference value for the temperature drop rate was determined. Accordingly, when the fixing unit 30 is made to resume the temperature increasing operation, a temperature rise should be easier in the actual state of the fixing roller 31 than in the state where the reference value for the temperature rise rate was determined. Thus, the temperature rise rate is predicted to be higher than the reference value: $\Delta T^U>\Delta T^U_R$.

Since the difference $\Delta T^D-\Delta T^D_R$ between the calculated value of the temperature drop rate and the reference value reflects the difference in the rate of heat release from the fixing roller 31 between the actual state of the fixing unit 30 and the state in which the reference value was determined as described above, the sign of the difference $\Delta T^U-\Delta T^U_R$ between the temperature rise rate and the reference value is predicted from the sign of the difference $\Delta T^D-\Delta T^D_R$. Further, the above described calculation to be performed by the temperature rise rate predicting unit 512 is based on the assumption that "each difference is sufficiently small, and those differences are proportional to each other". Particularly, the proportionality coefficient is set at "−1".

As described above, if the difference $\Delta T^D-\Delta T^D_R$ between the calculated value of the temperature drop rate and the reference value is a positive value, the temperature rise rate predicting unit 512 predicts the value of the temperature rise rate to be lower than the reference value by an amount proportional to the difference $\Delta T^D-\Delta T^D_R$. In this case, as indicated by the thin solid line in FIG. 4B, the intersection point CRE between the temperature drop curve and the temperature rise curve is shifted forward in terms of time, compared with the intersection point CRS in the case where the tilts of those curves are equal to the reference values. If the difference $\Delta T^D-\Delta T^D_R$ between the calculated value of the temperature drop rate and the reference value is a negative value, on the other hand, the temperature rise rate predicting unit 512 predicts the value of the temperature rise rate to be higher than the reference value by an amount proportional to the difference $\Delta T^D-\Delta T^D_R$. In this case, as indicated by the dot-and-dash line in FIG. 4B, the intersection point CRL between the temperature drop curve and the temperature rise curve is shifted backward in terms of time, compared with the intersection point CRS in the case where the tilts of those curves are equal to the reference values. In the above manner, the predicted temperature rise curve TUL passes through the point GL without fail, even if the actual state of the fixing unit 30 differs from the state in which the reference values for the temperature drop rate and the temperature rise rate were determined. That is, this temperature rise curve ensures that, "by the time when the feeding of the (N+1)th sheet is started, the temperature of the fixing roller 31 reaches the target value for the sheet".

—Flowcharts of the Temperature Control—

Figure 5:
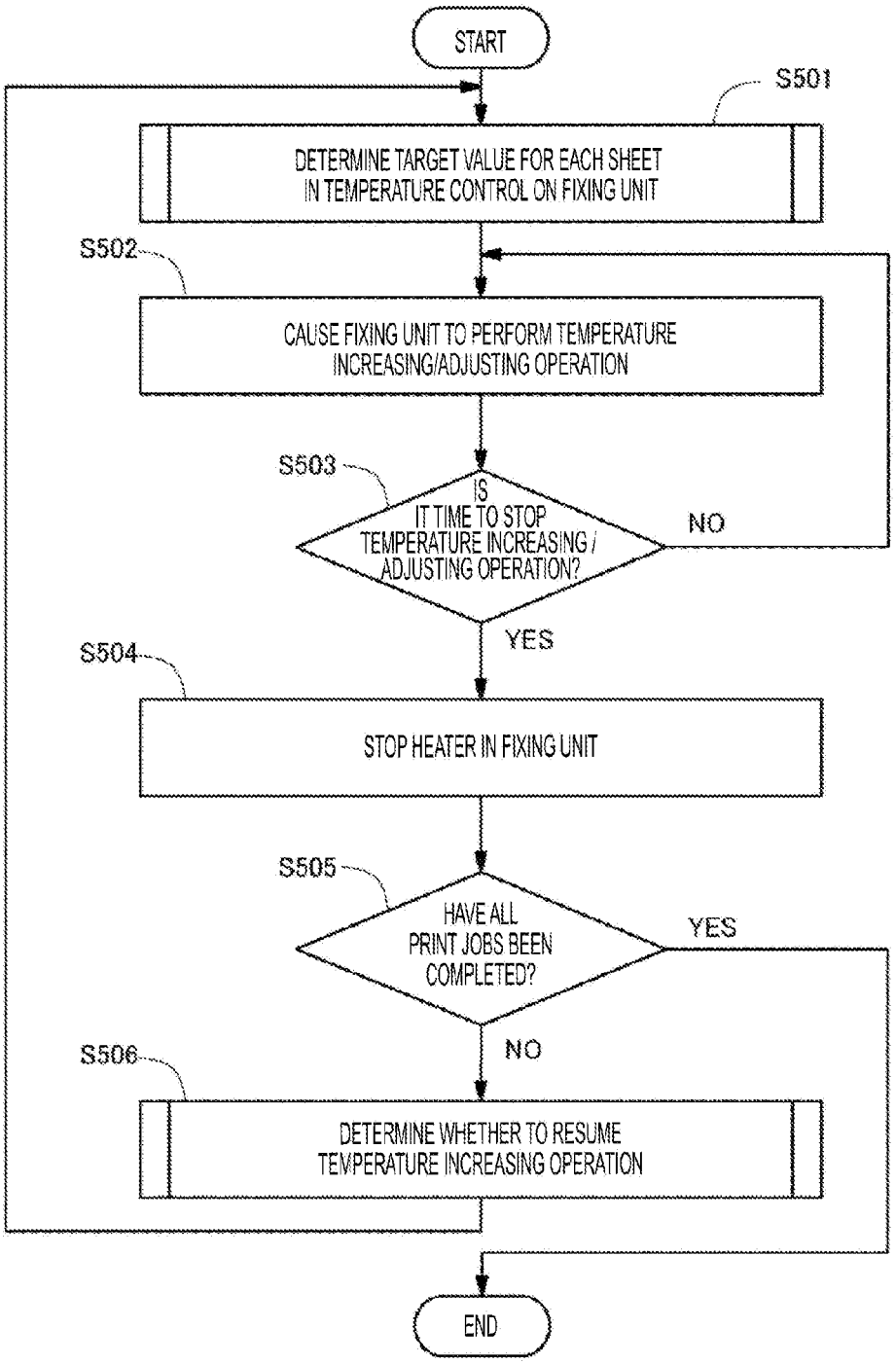
FIG. 5 is a flowchart of the temporal control to be performed on the fixing member to realize the temporal variation shown in FIG. 3.

FIG. 5 is a flowchart of the control to be performed by the control unit 50 on the temperature of the fixing roller 31. This control is started when the operating unit 40 receives a print request. The example case described below is based on the assumption that two or more substantially blank sheets, or sheets each requiring a smaller toner amount than the threshold value for forming a toner image, are not to be successively output, as shown in FIG. 3. That is, one or more toner images having a total area equal to or larger than the lower limit value are formed on each of the (N−1)th sheet and the (N+1)th sheet located immediately before and after the Nth sheet that is to be output as a substantially blank sheet.

In step S501, for each sheet to be subjected to printing, the control unit 50 determines a target value to be maintained by the temperature of the fixing roller 31 at the time of the printing. Specifically, the image analyzing unit 514 first analyzes the image data IMG or the PDL indicated by the print request newly received by the operating unit 40, and creates or updates toner amount information. Based on the toner amount information, the instructing unit 513 determines a target value for each sheet in the temperature control to be performed on the fixing roller 31. The instructing unit 513 further identifies sheets such as the Nth sheet for which any target value has not been determined since the amount of toner required by each of the sheets to form a toner image is smaller than the threshold value, and then determines that the scheduled end time of the fixing process for the sheet located immediately before each identified sheet, such as the scheduled end time $t_E(N-1)$ of the fixing process for the (N−1)th sheet, is the stop time of the temperature increasing operation or the like. After that, the process moves on to step S502. This step will be described later in detail.

In step S502, the instructing unit 513 acquires the current temperature of the fixing roller 31 from the temperature sensor 34, and compares the current temperature with the target value determined for the next sheet to be processed. In a case where the current temperature is clearly lower than the target value, or where the difference between the current temperature and the target temperature is within an allowable range, the instructing unit 513 instructs the power supply unit 60 to supply power to the heater 31A in the fixing unit 30, and instructs the fixing unit 30 to perform the temperature increasing operation or the temperature adjusting operation. After that, the process moves on to step S503.

In step S503, the instructing unit 513 monitors whether the stop time determined in step S501 for the temperature increasing operation or the like has actually come. If the stop time has already come, the process moves on to step S504. If the stop time has not come yet, the process returns to step S502, and the above described procedures are repeated.

In step S504, the instructing unit 513 instructs the power supply unit 60 to cut off the power supply to the heater 31A in the fixing unit 30, since the stop time of the temperature increasing operation or the like has already come. Accordingly, the temperature increasing operation or the like of the fixing unit 30 is suspended. After that, the process moves on to step S505.

In step S505, the control unit 50 determines whether all the print jobs accepted by the operating unit 40 have been completed by the output of a substantially blank sheet during the suspended period of the temperature increasing operation or the like. If all the print jobs have been completed, the process comes to an end. If not all the print jobs have been completed, the process moves on to step S506.

In step S506, while the temperature increasing operation or the like of the fixing unit 30 remains suspended, the temperature drop rate calculating unit. 511 estimates the temperature drop curve of the fixing roller 31 from measured values supplied from the temperature sensor 34, and, based on this temperature drop curve, the instructing unit 513 determines whether to cause the fixing unit 30 to resume the temperature increasing operation. If the temperature increasing operation is to be resumed, the temperature rise rate predicting unit 512 predicts the temperature rise rate of the fixing roller 31 from the temperature drop rate calculated by the temperature drop rate calculating unit 511, and the instructing unit 513 estimates the temperature rise curve of the fixing roller 31 from the temperature rise rate and determines that the time represented by the intersection point between the temperature rise curve and the temperature drop curve is the time to resume the temperature increasing operation. After that, the process returns to step S501, and the above described procedures are repeated. This step will be described later in detail.

Figure 6:
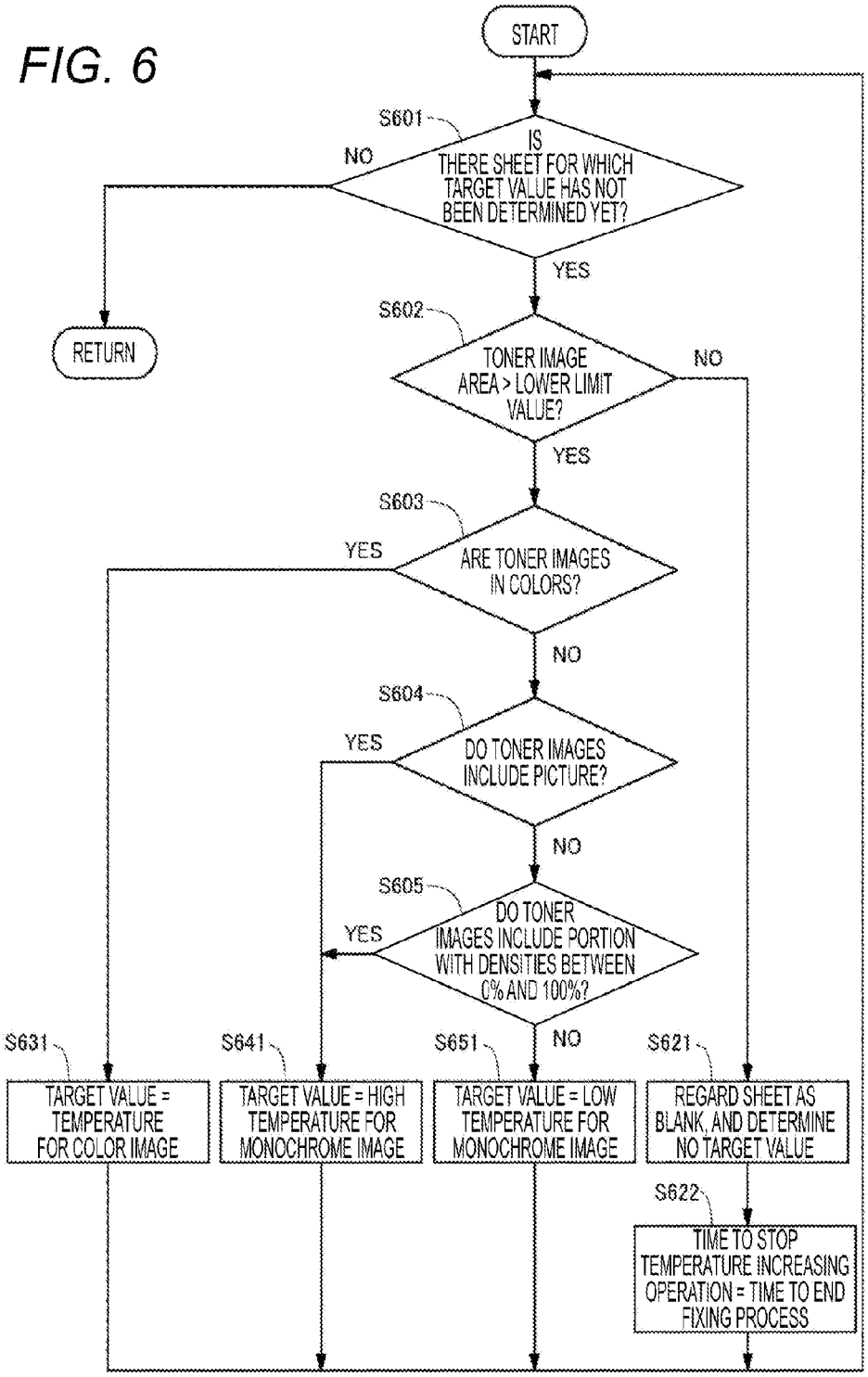
FIG. 6 is a flowchart of step S501 shown in FIG. 5, or the process of determining a target value for each sheet in the temperature control to be performed on the fixing member.

FIG. 6 is a flowchart of step S501 shown in FIG. 5, or the process of determining a target value for each sheet in the temperature control to be performed on the fixing roller 31.

In step S601, the instructing unit 513 determines whether there is one or more sheets for which any target value has not been determined among the sheets to be processed. If there is one or more sheets for which any target value has not been determined yet, the process moves on to step S602. If there are no such sheets, the process returns to the flowchart shown in FIG. 5, and moves on to step S502.

In step S602, the image analyzing unit 514 first extracts one of the sheets for which any target value has not been determined yet, and determines whether there is one or more toner images to be formed on the sheet. If there is one or more toner images, the image analyzing unit 514 further determines whether the total area of these toner images is larger than the lower limit value. If there are toner images to be formed and the total area of these toner images is larger than the lower limit value, the process moves on to step S603. If there are no toner images to be formed, or if the total area of the toner images to be formed is not larger than the lower limit value, the process moves on to step S621.

In step S621, there are no toner images to be formed on the sheet extracted in step S602, or the total area of the toner images to be formed on the sheet is smaller than the lower limit value. In this case, the image analyzing unit 514 determines that "this sheet is to be output as a substantially blank sheet", and writes "the amount of toner to be used for this sheet is smaller than the threshold value" into the toner amount information. Based on the toner amount indicated by the toner amount information, the instructing unit 513 does not determine any target value for this sheet. After that, the process moves on to step S622.

In step S622, the instructing unit 513 determines that the scheduled time at which the fixing unit 30 is to end the fixing process for the sheet located immediately before the sheet for which any target value has not been determined in step S621 is the time to stop the temperature increasing operation. After that, the process returns to step S601, and the above described procedures are repeated.

In step S603, there are toner images to be formed on the sheet extracted in step S602, and the total area of these toner images is larger than the lower limit value. In this case, the image analyzing unit 514 determines whether these toner images are color images. If the toner images include a color portion, the process moves on to step S631. If the toner images do not include any color portion, the process moves on to step S604.

In step S631, the toner images to be formed on the sheet extracted in step S602 include a color portion. In this case, the image analyzing unit 514 writes "the amount of toner to be used for this sheet is a value necessary for forming a color toner image" into the toner amount information. Based on the toner amount indicated by the toner amount information, the instructing unit 513 determines that the target value for the sheet is a sufficiently high temperature for thermally fixing a color toner image, such as 190° C. After that, the process returns to step S601, and the above described procedures are repeated.

In step S604, all the toner images to be formed on the sheet extracted in step S602 are monochrome images. In this case, the image analyzing unit 514 determines whether these toner images include a picture. If the toner images include a picture, the process moves on to step S641. If the toner images do not include any picture, the process moves on to step S605.

In step S605, all the toner images to be formed on the sheet extracted in step S602 are not pictures but monochrome text or figures, for example. In this case, the image analyzing unit 514 determines whether these toner images include a portion with toner densities of 100%, 0%, and an intermediate value between 0% and 100%. If the toner images include such a portion, the process moves on to step S641. If the toner images do not include such a portion, the process moves on to step S651.

In step S641, all the toner images to be formed on the sheet extracted in step S602 are monochrome images, and these toner images include a picture or a portion with at least three toner densities of 100%, 0%, and an intermediate value between 0% and 100%. In this case, the image analyzing unit 514 writes "the amount of toner to be used for this sheet is a value necessary for forming a toner image of a monochrome picture" into the toner amount information. Based on the toner amount indicated by the toner amount information, the instructing unit 513 determines that the target value for the sheet is a sufficiently high temperature for thermally fixing a toner image of a monochrome picture, such as 170° C. After that, the process returns to step S601, and the above described procedures are repeated.

In step S651, all the toner images to be formed on the sheet extracted in step S602 are monochrome binary images. In this case, the image analyzing unit 514 writes "the amount of toner to be used for this sheet is a value necessary for forming a monochrome binary toner image" into the toner amount information. Based on the toner amount indicated by the toner amount information, the instructing unit 513 determines that the target value for the sheet is a sufficiently low temperature for thermally fixing a monochrome binary toner image, such as 150° C. After that, the process returns to step S601, and the above described procedures are repeated.

Figure 7:
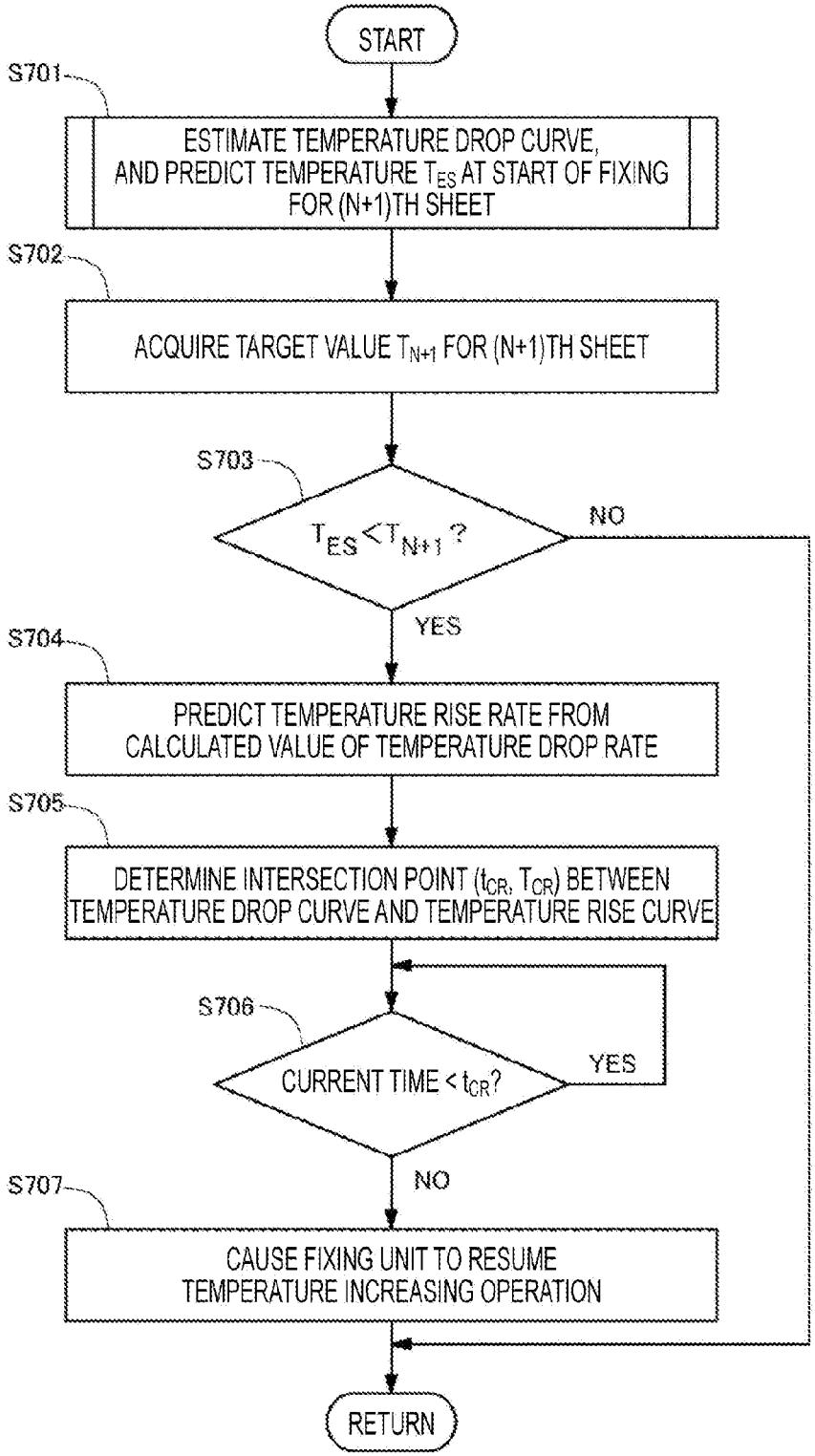
FIG. 7 is a flowchart of step S506 shown in FIG. 5, or the process of determining whether to cause the fixing unit to resume a temperature increasing operation.

FIG. 7 is a flowchart of step S506 shown in FIG. 5, or the process of determining whether to cause the fixing unit 30 to resume the temperature increasing operation.

In step S701, from measured values supplied from the temperature sensor 34, the temperature drop rate calculating unit 511 estimates the temperature drop curve of the fixing roller 31 during a suspended period of the temperature increasing operation or the like of the fixing unit 30. Under the assumption that "the temperature increasing operation or the like of the fixing unit 30 remains suspended", the temperature drop rate calculating unit 511 further predicts, from the temperature drop curve, the temperature $T_{ES}$ of the fixing roller 31 at the time $t_S$(N+1) when the feeding of the sheet such as the (N+1)th sheet that comes immediately after the sheet regarded as substantially blank to the fixing unit 30 is started. After that, the process moves on to step S702. This step will be described later in detail.

In step S702, the instructing unit 513 acquires the target value $T_{N+1}$ for the sheet such as the (N+1)th sheet that comes immediately after the sheet regarded as substantially blank. After that, the process moves on to step S703.

In step S703, the instructing unit 513 compares the predicted value $T_{ES}$ determined in step S701 with the target value $T_{N+1}$ acquired in step S702. If the predicted value $T_{ES}$ is smaller than the target value $T_{N+1}$, the process moves on to step S704. If the predicted value $T_{ES}$ is not smaller than the target value $T_{N+1}$, the process returns to the flowchart shown in FIG. 5, and the procedures starting from step S501 are repeated.

In step S704, it is assumed that "if the temperature increasing operation or the like of the fixing unit 30 remains suspended, the temperature $T_{ES}$ of the fixing roller 31 is lower than the target value $T_{N+1}$ for the sheet next to the sheet regarded as substantially blank at the time when the feeding of the next sheet to the fixing unit 30 is started". Based on this assumption, the instructing unit 513 determines that "the fixing unit 30 is to resume the temperature increasing operation", and causes the temperature rise rate predicting unit 512 to predict the temperature rise rate of the fixing roller 31. Specifically, the temperature rise rate predicting unit 512 first acquires, from the respective components in the image forming apparatus 100, the parameter values indicating the actual operating conditions, such as a sheet attribute and a measured value of the internal or ambient temperature of the fixing unit 30. The temperature rise rate predicting unit 512 then reads $\Delta T^U_R$ and $\Delta T^D_R$ associated with the combination of the acquired parameter values, from among the reference values for the temperature rise rate and the temperature drop rate specified in the tables stored in the ROM 53. The temperature rise rate predicting unit 512 then calculates a predicted value $\Delta T^U$ of the temperature rise rate by plugging these reference values $\Delta T^U_R$ and $\Delta T^D_R$ and the temperature drop rate $\Delta T^D$ calculated by the temperature drop rate calculating unit 511 into the following equation: $\Delta T^U = \Delta T^U_R - (\Delta T^U - \Delta T^D_R)$. After that, the process moves on to step S705.

In step S705, the instructing unit 513 has the temperature rise curve of the fixing roller 31 approximated by a straight line that has a tilt represented by the predicted value $+\Delta T^U$ of the temperature rise rate predicted by the temperature rise rate predicting unit 512, like the straight line TUL shown in FIG. 3. The instructing unit 513 further determines the coordinates ($t_{CR}$, $T_{CR}$) of the intersection point between the temperature rise curve and the temperature drop curve, and determines that the time $t_{CR}$ indicated by the coordinates is the time to cause the fixing unit 30 to resume the temperature increasing operation. After that, the process moves on to step S706.

In step S706, the instructing unit 513 monitors whether the time $t_{CR}$ to cause the fixing unit 30 to resume the temperature increasing operation has come, and the process is suspended until the time $t_{CR}$ comes. If the time $t_{CR}$ has already come, the process moves on to step S707.

In step S707, the time $t_{CR}$ to cause the fixing unit 30 to resume the temperature increasing operation has already come, and therefore, the instructing unit 513 instructs the power supply unit 60 to resume the power supply to the heater 31A in the fixing unit 30. Accordingly, the fixing unit 30 resumes the temperature increasing operation. After that, the process returns to the flowchart shown in FIG. 5, and the procedures starting from step S501 are repeated.

Figure 8:
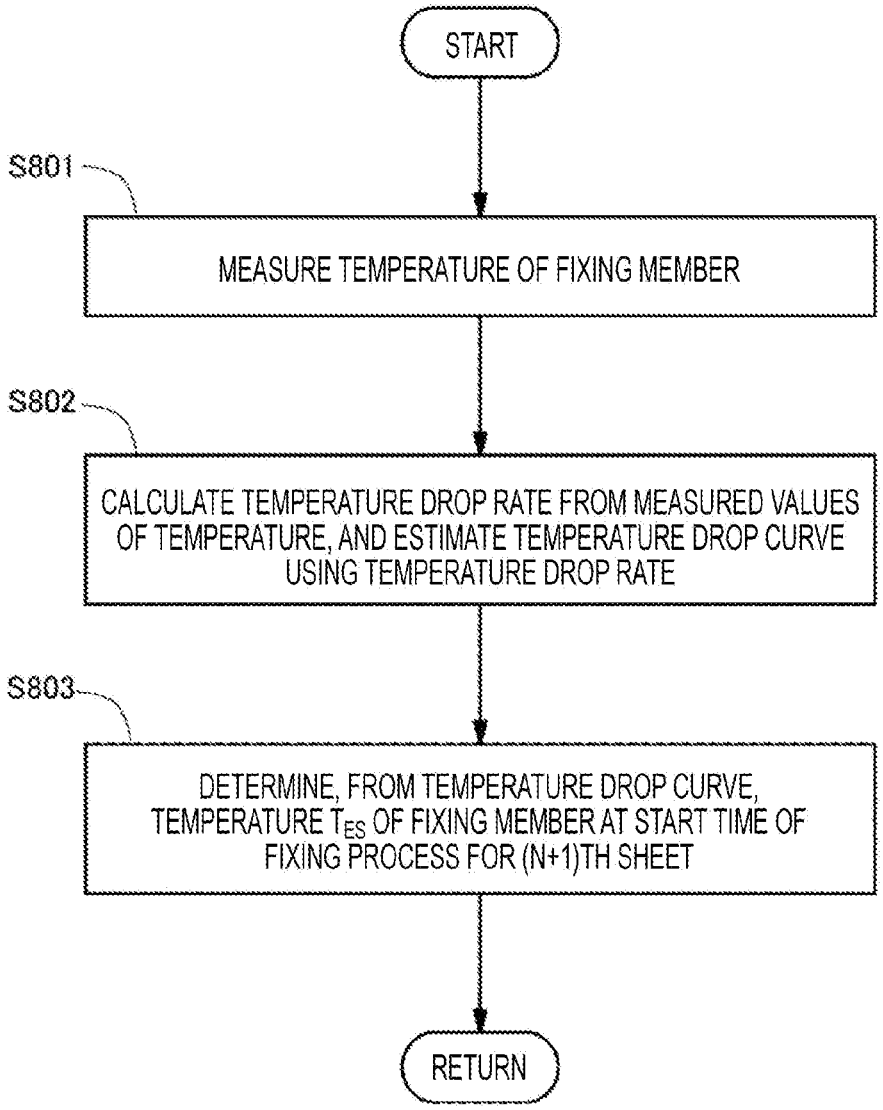
FIG. 8 is a flowchart of step S701 shown in FIG. 7, or the process of predicting the temperature of the fixing member at the time when the sheet next to a sheet regarded as substantially blank starts being fed to the fixing unit.

FIG. 8 is a flowchart of step S701 shown in FIG. 7, or the process of predicting the temperature of the fixing roller 31 at the time when the feeding of the sheet next to the sheet regarded as substantially blank to the fixing unit 30 is started.

In step S801, while the temperature increasing operation or the like of the fixing unit 30 remains suspended, the temperature drop rate calculating unit 511 receives a measured value of the temperature of the fixing roller 31 from the temperature sensor 34 at least twice. After that, the process moves on to step S802.

In step S802, the temperature drop rate calculating unit 511 calculates the temperature drop rate of the fixing roller 31 from the measured values supplied from the temperature sensor 34, and estimates the temperature drop curve of the fixing roller 31 by using the temperature drop rate. As shown in FIG. 3, this temperature drop curve is approximated by the straight line TDL that has the calculated temperature drop rate as its tilt, and passes through the point ST at the coordinates representing the combination of the end time $t_E(N-1)$ of the fixing process for the sheet such as the (N−1)th sheet immediately before the sheet regarded as substantially blank and the target value $T_{N-1}$ for the (N−1)th sheet. After that, the process moves on to step S803.

In step S803, the temperature drop rate calculating unit 511 plugs the start time $t_S(N+1)$ of the fixing process for the sheet such as the (N+1)th sheet next to the sheet regarded as substantially blank into the linear equation representing the straight line TDL approximating the temperature drop curve estimated in step S802, and calculates the temperature $T_{ES}$ corresponding to this time. If the temperature increasing operation or the like of the fixing unit 30 remains suspended, the temperature of the fixing roller 31 drops to the calculated value $T_{ES}$ by this time. After that, the process returns to the flowchart shown in FIG. 7, and moves on to step S702.

[Advantages of the Embodiment]

As described above, the image forming apparatus 100 according to an embodiment of the present invention first calculates the temperature drop rate of the fixing roller 31 from the actual temperature of the fixing roller 31 measured by the temperature sensor 34 while the temperature increasing operation or the like of the fixing unit 30 remains suspended. Under the assumption that "the difference between the calculated value of the temperature drop rate and the reference value for the temperature drop rate is proportional to the difference between the actual value of the temperature rise rate and the reference value for the temperature rise rate", the image forming apparatus 100 then predicts the temperature rise rate of the fixing roller 31 at the time when the fixing unit 30 is made to resume the temperature increasing operation. Reflecting the value of the temperature drop rate that has been actually measured, this predicted value of the temperature rise rate has a high degree of accuracy. As a result, the image forming apparatus 100 can accurately determine the time to cause the fixing unit 30 to resume the temperature increasing operation, in accordance with the actual thermal state of the fixing roller 31. Accordingly, while degradation of printing quality due to insufficient thermal fixing is prevented, the fixing unit 30 is made to shorten the duration of the temperature increasing operation so that the power to be consumed by the temperature increasing operation can be reduced.

[Modifications]

(A) The image forming apparatus 100 is a color laser printer. Alternatively, the image forming apparatus 100 may be any apparatus that thermally fixes a toner image on a sheet, such as a monochrome laser printer, a facsimile machine, a copying machine, or a multi-function peripheral (MFP).

(B) The material of sheets that is supplied from the sheet feeding unit 10 is paper. Alternatively, the sheets may be made of resin, like OHP films. The sheet feeding unit 10 may include two or more container trays, and sheets of various sizes such as A3, A4, A5, and B4 maybe stored in these container trays. The sheet feeding unit 10 may further include a mechanism for duplex printing.

(C) In the fixing unit 30, the heater 31A in the fixing roller 31 is a halogen lamp. Alternatively, the heater 31A may be an induction heating apparatus. Instead of the fixing roller 31, the fixing unit 30 may include a combination of a fixing belt to be brought into contact with a sheet and a device for heating the fixing belt.

(D) The control unit 50 causes the operating unit 40 to receive image data IMG from a PC in a LAN via the LAN interface 83. Alternatively, the control unit 50 may convert a document image into image data IMG, using the scanner 81 or a camera installed in the image forming apparatus 100. Further, the control unit 50 may acquire image data IMG from an external electronic device via a video input terminal such as a USB port or a memory card slot in the memory interface 82.

(E) As shown in the table in FIG. 4A, the respective reference values for the temperature rise rate and the temperature drop rate are defined in accordance with combinations of parameter values of "sheet type (weighing capacity)" and "environmental temperature". Alternatively, reference values for at least one of the rates may be defined by the parameter values of the one of the rates, and may be invariable not depending on any parameter values.

The parameter types that define reference values are not limited to "sheet type" and "environmental temperature". In a case where the fixing unit 30 further includes a detecting unit that detects the temperature of the pressure roller 32, for example, the temperature rise rate predicting unit 512 may use detected values supplied from the detecting unit in predicting the temperature rise rate of the fixing unit 30. In practice, the amount of heat transferred from the fixing roller 31 to the pressure roller 32 through the sheet in the fixing nip during the fixing process depends on the temperature of the pressure roller 32, and accordingly, the temperature rise rate and the temperature drop rate also depend on the temperature of the pressure roller 32.

In a case where detected values supplied from the detecting unit are used in predicting the temperature rise rate of the fixing roller 31, tables similar to the table shown in FIG. 4A are created with respect to respective reference values for the temperature rise rate and the temperature drop rate, and are stored into the ROM 53. These tables specify the respective reference values for the temperature rise rate and the temperature drop rate in accordance with combinations of sheet types, environmental temperatures, and values of the temperature of the pressure roller 32. Specific numerical values to be allotted to the respective combinations are determined through an experiment conducted prior to actual printing operations.

(F) The fixing member such as the fixing roller 31 may be movable between a first position in contact with the sheet traveling in the fixing unit and a second position not in contact with the sheet. In this case, in accordance with an instruction issued from the instructing unit 513 to stop the temperature increasing operation or the like, the fixing unit 30 may move the fixing member from the first position to the second position. As a result, the temperature drop rate of the fixing member becomes lower, and the heat-retaining characteristics of the fixing member are improved. Accordingly, the consumption of power at the time when the temperature increasing operation is resumed can be reduced.

(G) The time to cause the fixing unit 30 to resume the temperature increasing operation and the temperature of the fixing roller 31 are determined when the following phenomenon is predicted from the temperature drop curve: "if the temperature increasing operation or the like of the fixing unit 30 remains suspended, the temperature of the fixing roller 31 is lower than the target value for the next sheet to which a toner image is to be thermally fixed at the time when the feeding of the next sheet to the fixing unit 30 is started." Alternatively, the determination may be performed when the following phenomenon is predicted by using the temperature rise rate predicted from the calculated value of the temperature drop rate: "if the temperature increasing operation of the fixing unit 30 is resumed at the moment, the temperature of the fixing roller 31 reaches the target value for the next sheet to be subjected to thermal toner image fixing by the time when the feeding of the next sheet to the fixing unit 30 is started".

(H) In the table shown in FIG. 4A, the reference value $\Delta T^U_R$ for the temperature rise rate is set at "high speed" or "intermediate speed" if the weighting capacity of the sheet is less than 90 g/m$^2$, and is set at "intermediate speed" or "low speed" if the weighing capacity of the sheet is equal to or more than 90 g/m$^2$. Alternatively, the temperature rise rate predicting unit 512 may calculate the reference value $\Delta T^U_R$ for the temperature rise rate according to the following equation that is based on the assumption that "the amount of heat absorbed from the fixing roller 31 by the sheet fed to the fixing unit 30 is proportional to the weighing capacity W of the sheet": $\Delta T^U_R = T_0 - k \times W$. Here, the constant $T_0$ and the proportionality coefficient k are both positive values, and are determined through an experiment.

(I) The instructing unit 513 determines that the time $t_{CR}$ indicated by the coordinates of the intersection point between the temperature rise curve and the temperature drop curve is the time to cause the fixing unit 30 to resume the temperature increasing operation, and causes the fixing unit 30 to resume the temperature increasing operation when the time $t_{CR}$ comes. Alternatively, the instructing unit 513 may determine that the temperature $T_{CR}$ indicated by the coordinates of the intersection point is the temperature at which the fixing unit 30 is to be caused to resume the temperature increasing operation. When the value measured by the temperature sensor 34 drops to the temperature $T_{CR}$, the instructing unit 513 causes the fixing unit 30 to resume the temperature increasing operation. Also, the instructing unit 513 may not determine the intersection point between the temperature rise curve and the temperature drop curve, and continues to monitor the temperature of the fixing roller 31 through the value measured by the temperature sensor 34 while the temperature increasing operation or the like of the fixing unit 30 remains suspended. In this case, the instructing unit 513 causes the fixing unit 30 to resume the temperature increasing operation when the point at the coordinates representing the combination of the current time and temperature is detected from the temperature rise curve.

(J) In the example shown in FIG. 3, unlike the (N−1)th sheet and the (N+1)th sheet before and after the Nth sheet, only the Nth sheet is output as a substantially blank sheet. Alternatively, two or more substantially blank sheets may be successively output. In this case, based on the toner amount information, the instructing unit 513 detects the boundary as the transition from a sheet requiring an amount of toner equal to or larger than the threshold value required for forming a toner image, to a sheet requiring a smaller amount of toner than the threshold value, and instructs the fixing unit 30 to suspend the temperature increasing operation or the like when the fixing process for the sheet located immediately before the boundary ends.

Figure 9:
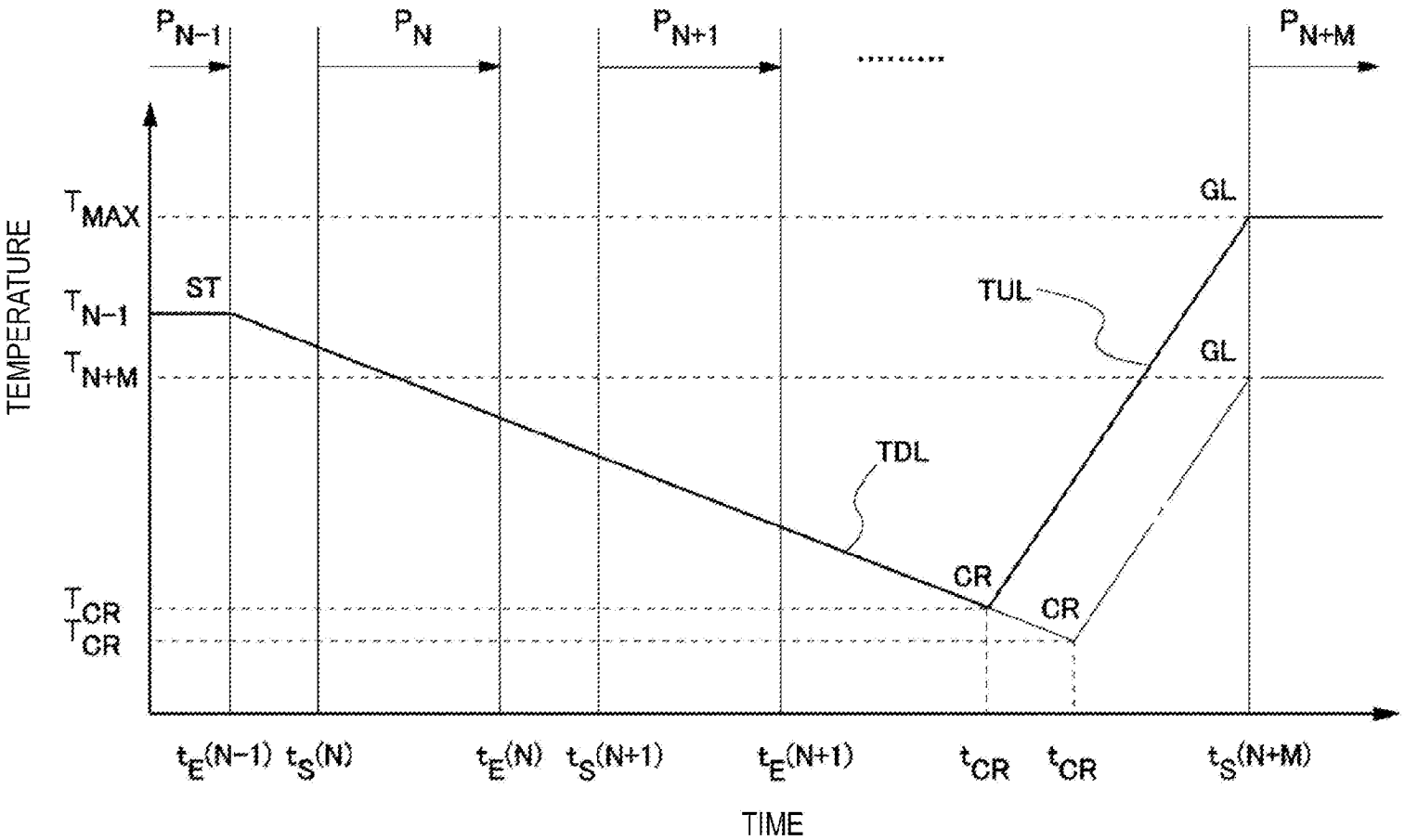
FIG. 9 is a graph showing another example of a temporal variation in the temperature of the fixing member shown in FIG. 1.

FIG. 9 is a graph showing another example of a variation in the temperature of the fixing roller 31 with time. As shown in FIG. 9, in periods $P_{N-1}$, $P_N$, $P_{N+1}$, . . . , and $P_{N+M}$, the (N−1)th sheet, the Nth sheet, the (N+1)th sheet, . . . , and the (N+M)th sheet are sequentially fed to the fixing unit 30. The characters M and N represent integers of 2or greater.

FIG. 9 differs from FIG. 3 in that the following cases are assumed: "the M sheets from the Nth sheet to the (N+M−1)th sheet are output as substantially blank sheets, unlike the (N−1)th sheet located immediately before the Nth sheet", and "in the first stage of determining a target value for each sheet in the temperature control on the fixing roller 31, the toner amount information about the (N+M)th sheet and the later sheets has not been created yet." In this case, the toner amount information about each of the Nth to (N+M−1)th sheets indicates a smaller toner amount than the threshold value. Therefore, the instructing unit 513 determines a target value $T_{N-1}$ for the (N−1)th sheet, but does not determine any target value for the Nth to (N+M−1)th sheets. For the (N+M)th sheet and the later sheets, the instructing unit 513 further determines an upper limit value $T_{MAX}$ as the target value, since the amount of toner required for any of these sheets is unknown.

Not having determined any target value for the Nth to (N+M−1)th sheets, the instructing unit 513 causes the fixing unit 30 to stop the temperature increasing operation or the like at the end time $t_E(N-1)$ of the fixing process for the (N−1)th sheet. As a result, after the end time $t_E(N-1)$, the temperature of the fixing roller 31 drops.

While the temperature increasing operation or the like of the fixing unit 30 remains suspended, the temperature drop rate calculating unit 511 calculates the temperature drop rate $-\Delta T^D$ of the fixing roller 31 from measured values supplied from the temperature sensor 34, and, using this calculated value $-\Delta T^D$, estimates the straight line TDL approximating the temperature drop curve of the fixing roller 31 after the time $t_E(N-1)$.

Since the target value for the (N+M)th sheet is set at the upper limit value $T_{MAX}$, the temperature of the fixing roller 31 is definitely lower than the target value $T_{MAX}$ at the time $t_S(N+M)$ when the feeding of the (N+M)th sheet to the fixing unit 30 is started, if the temperature increasing operation or the like of the fixing unit 30 remains suspended. Therefore, the instructing unit 513 determines that "the fixing unit 30 is to resume the temperature increasing operation", and causes the temperature rise rate predicting unit 512 to predict the temperature rise rate of the fixing roller 31. The instructing unit 513 then estimates the straight line TUL approximating the temperature rise curve from the predicted value of the temperature rise rate, and determines the time $t_{CR}$ indicated by the coordinates of the intersection point CR between the temperature rise curve TUL and the temperature drop curve TDL.

Until the time $t_{CR}$ actually comes, the temperature drop curve estimation, the temperature rise curve prediction, and the calculation of the coordinates of the intersection point between the temperature drop curve and the temperature rise curve are repeated. If the toner amount information is updated and a toner amount for the (N+M)th sheet is specified before the time $t_{CR}$, the instructing unit 513 changes the target value for the (N+M)th sheet from the upper limit value $T_{MAX}$ to a true value $T_{N+M}$ based on the updated toner amount information. As a result, the predicted temperature rise curve is corrected as indicated by the dot-and-dash line in FIG. 9.

—Flowcharts of the Temperature Control—

The flowcharts of the temperature control to be performed by the control unit 50 on the fixing roller 31 are substantially the same as those shown in FIGS. 5 to 8, but the details of step S506 for determining whether to cause the fixing unit 30 to resume the temperature increasing operation partially differs from those shown in FIG. 7. Therefore, only the different aspects from step S506 will be described below, as the other aspects have been described above with reference to FIGS. 5 to 8.

Figure 10:
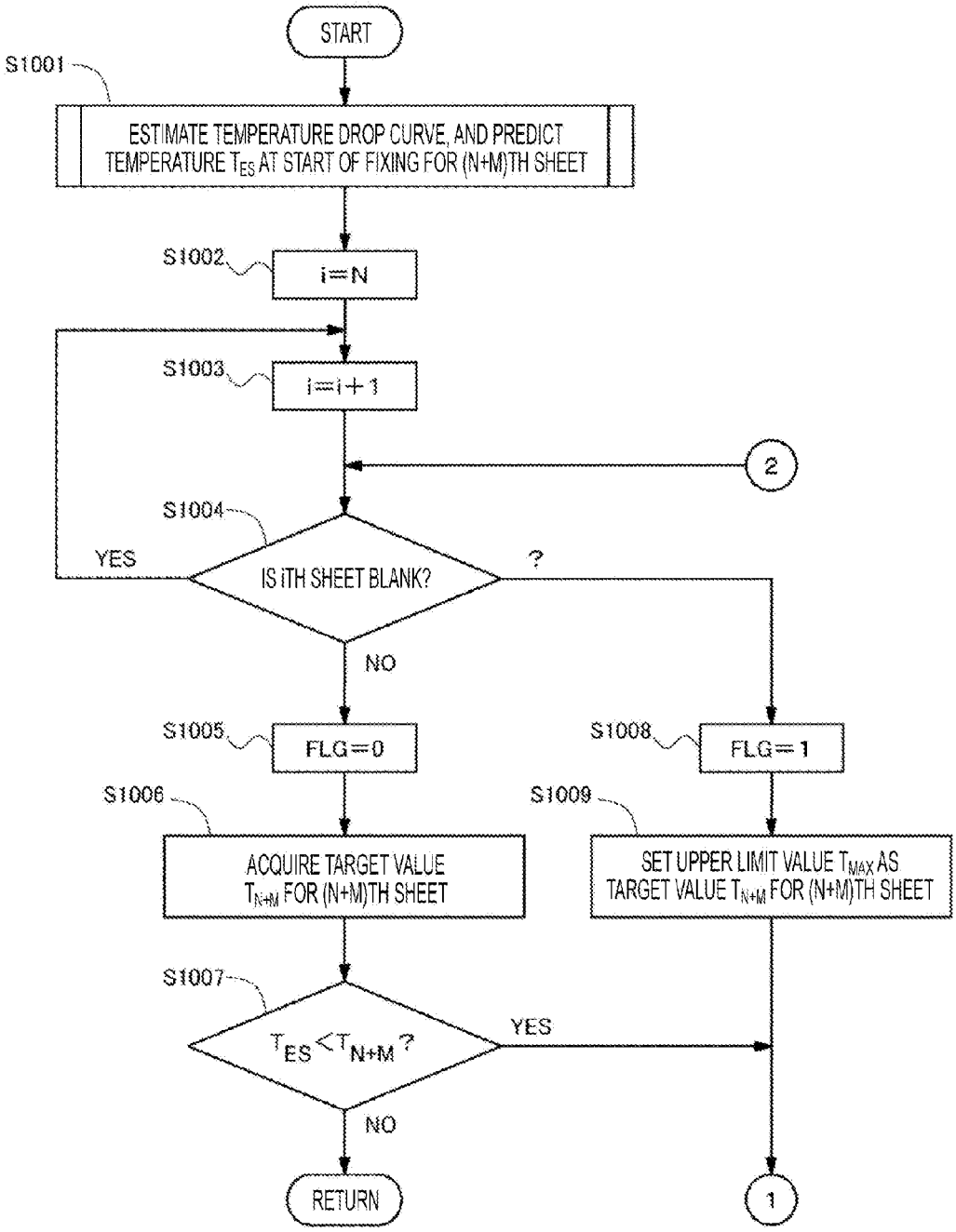
FIG. 10 is the first half of a flowchart of step S506 shown in FIG. 5 or the process of determining whether to cause the fixing unit to resume a temperature increasing operation in the temperature control being performed on the fixing member to realize the temporal variation shown in FIG. 9.
Figure 11:
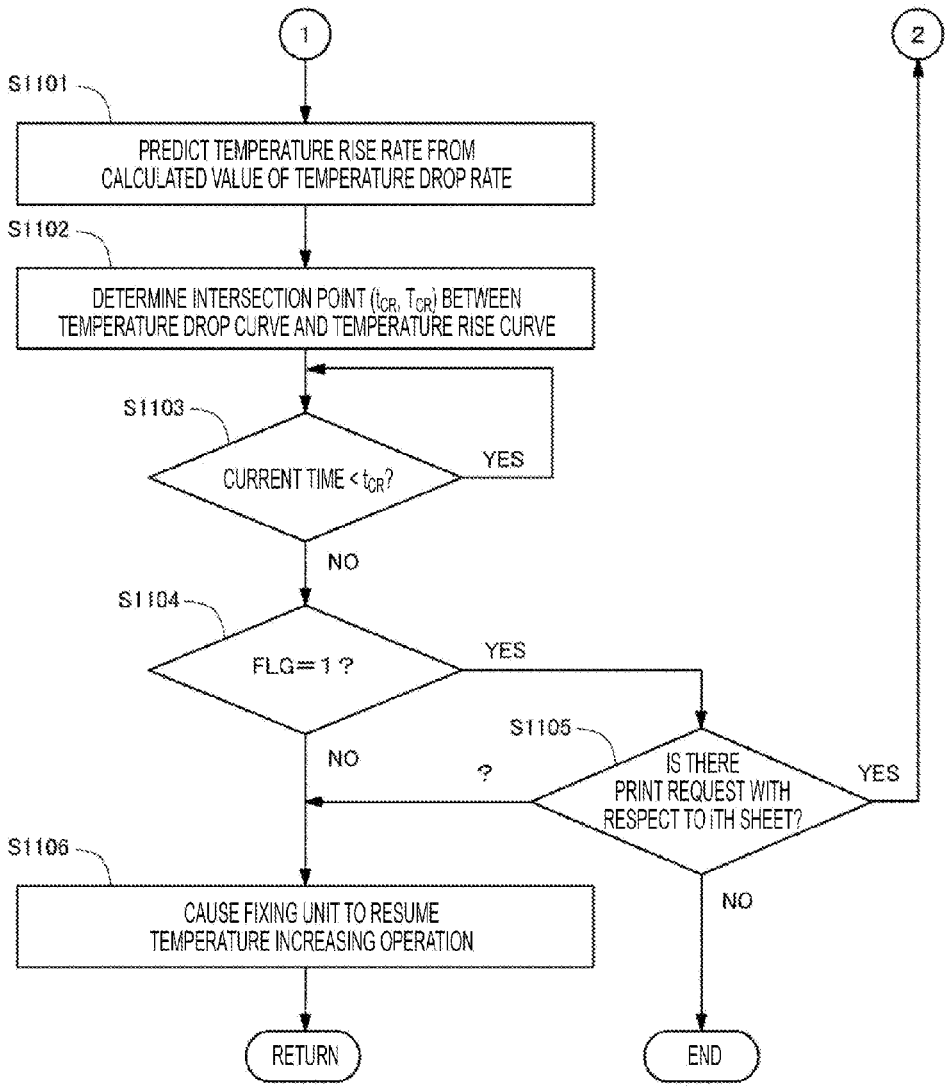
FIG. 11 is the second half following the first half of the flowchart shown in FIG. 10.

FIGS. 10 and 11 are flowcharts of step S506 shown in FIG. 5, or the process of determining whether to cause the fixing unit 30 to resume the temperature increasing operation. In the example case described below, M substantially blank sheets starting from the Nth sheet are to be successively output as shown in FIG. 9.

In step S1001, from measured values supplied from the temperature sensor 34, the temperature drop rate calculating unit 511 estimates the temperature drop curve of the fixing roller 31 during a suspended period of the temperature increasing operation or the like of the fixing unit 30. Under the assumption that "the temperature increasing operation or the like of the fixing unit 30 remains suspended", the temperature drop rate calculating unit 511 further predicts, from the temperature drop curve, the temperature $T_{ES}$ of the fixing roller 31 at the time $t_S$(N+M) when the feeding of the (N+M)th sheet to the fixing unit 30 is started after the M sheets regarded as substantially blank are fed to the fixing unit 30. After that, the process moves on to step S1002.

In step S1002, the instructing unit 513 initializes and changes the integer variable i to the identification number "N" of the Nth sheet located at the top of the group of successive sheets substantially regarded as blank. After that, the process moves on to step S1003.

In step S1003, the instructing unit 513 increments the integer variable i by "1": i=i+1. After that, the process moves on to step S1004.

In step S1004, based on the latest toner amount information, the instructing unit 513 determines whether the toner amount information indicates a smaller toner amount than the threshold value for the ith sheet, or whether the ith sheet is to be output as a substantially blank sheet. If the toner amount information indicates a smaller toner amount than the threshold value for the ith sheet, the procedures in steps S1003 and S1004 are repeated. If the toner amount information indicates a finite toner amount, the process moves on to step S1005. If the toner amount information does not indicate any toner amount, the process moves on to step S1008.

Since the toner amount information indicates smaller toner amounts than the threshold value for the M successive sheets starting from the Nth sheet in the example shown in FIG. 9, the loop of steps S1003 and S1004 is repeated M times. If the toner amount information indicates a finite toner amount for the ith or (N+M)th sheet at the time when the integer variable i reaches the integer N+M, the process moves on to step S1005. If the toner amount information does not indicate any toner amount at this time, the process moves on to step S1008.

In step S1005, the toner amount information indicates a smaller toner amount than the threshold value for each of the Nth to (i−1)th or (N+M−1)th sheets, and indicates a finite toner amount for the ith or (N+M)th sheet. In this case, the temperature rise rate predicting unit 512 sets a flag variable FLG at "0": FLG=0. After that, the process moves on to step S1006.

In step S1006, the toner amount information indicates a finite toner amount for the ith or (N+M)th sheet, and therefore, the instructing unit 513 determines the target value in the temperature control on the fixing roller 31 to be the value $T_{N+M}$ corresponding to the finite toner amount. After that, the process moves on to step S1007.

In step S1007, the instructing unit 513 compares the predicted value $T_{ES}$ of the temperature of the fixing roller 31 at the time $t_S$(N+M) when the feeding of the (N+M)th sheet to the fixing unit 30 is started, with the target value $T_{N+M}$ for the (N+M)th sheet. If the predicted value $T_{ES}$ is smaller than the target value $T_{N+M}$, the process moves on to step S1101. If the predicted value $T_{ES}$ is not smaller than the target value $T_{N+M}$, the process returns to the flowchart shown in FIG. 5, and the procedures starting from step S501 are repeated.

In step S1008, the toner amount information indicates a smaller toner amount than the threshold value for each of the Nth to (i−1)th or (N+M−1)th sheets, and does not indicate any toner amount for the ith or (N+M)th sheet. In this case, the instructing unit 513 sets the flag variable FLG at "1": FLG=1. After that, the process moves on to step S1009.

In step S1009, the toner amount information does not indicate any toner amount for the ith or (N+M)th sheet, and therefore, the instructing unit 513 determines the target value in the temperature control on the fixing roller 31 to be the upper limit value $T_{MAX}$. After that, the process moves onto step S1101.

In step S1101, it is assumed that "if the temperature increasing operation of the fixing unit 30 remains suspended, the temperature $T_{ES}$ of the fixing roller 31 is lower than the target value $T_{N+M}$ for the (N+M)th sheet or $T_{MAX}$ at the time $t_S$(N+M) when the feeding of the (N+M)th sheet to the fixing unit 30 is started". Based on this assumption, the instructing unit 513 causes the temperature rise rate predicting unit 512 to predict the temperature rise rate of the fixing roller 31. After that, the process moves on to step S1102.

In step S1102, the instructing unit 513 estimates the temperature rise curve by using the predicted value of the temperature rise rate, and determines the coordinates ($t_{CR}$, $T_{CR}$) of the intersection point between the temperature rise curve and the temperature drop curve. After that, the process moves on to step S1103.

In step S1103, the instructing unit 513 monitors whether the time $t_{CR}$ to cause the fixing unit 30 to resume the temperature increasing operation has come, and the process is suspended until the time $t_{CR}$ comes. If the time $t_{CR}$ has already come, the process moves on to step S1104.

In step S1104, the instructing unit 513 determines whether the flag variable FLG is "1". If the flag variable FLG is "1", the process moves on to step S1105. If the flag variable FLG is not "1", the process moves on to step S1106.

In step S1105, the flag variable FLG is "1", and therefore, the toner amount information still does not indicate any toner amount for the ith or (N+M)th sheet. In this case, from the image data IMG and the like stored in the ROM 53, the image analyzing unit 514 determines whether there is a print request with respect to the ith or (N+M)th sheet. If there is such a request, the procedures in step S1004 and the later steps are repeated. If there is no such request, the process comes to an end. If the determination cannot be made yet, the process moves on to step S1106.

In step S1106, the time $t_{CR}$ to cause the fixing unit 30 to resume the temperature increasing operation has already come, and therefore, the instructing unit 513 instructs the power supply unit 60 to resume the power supply to the heater 31A in the fixing unit 30. Accordingly, the fixing unit 30 resumes the temperature increasing operation. After that, the process returns to the flowchart shown in FIG. 5, and the procedures starting from step S501 are repeated.

(K) In the example shown in FIG. 3, the instructing unit 513 does not determine any target value for the Nth sheet in the temperature control on the fixing roller 31, or regards the Nth sheet as substantially blank. Therefore, the instructing unit 513 instructs the fixing unit 30 to stop the temperature increasing operation or the like at the end time $t_E(N-1)$ of the fixing process for the (N−1)th sheet immediately before the Nth sheet. In a case where, between two successive sheets, the target value for the second sheet is lower than the target value for the first sheet by an allowable difference or more, the instructing unit 513 may further instruct the fixing unit 30 to stop the temperature increasing operation or the like at the end time of the fixing process for the first sheet.

Figure 12:
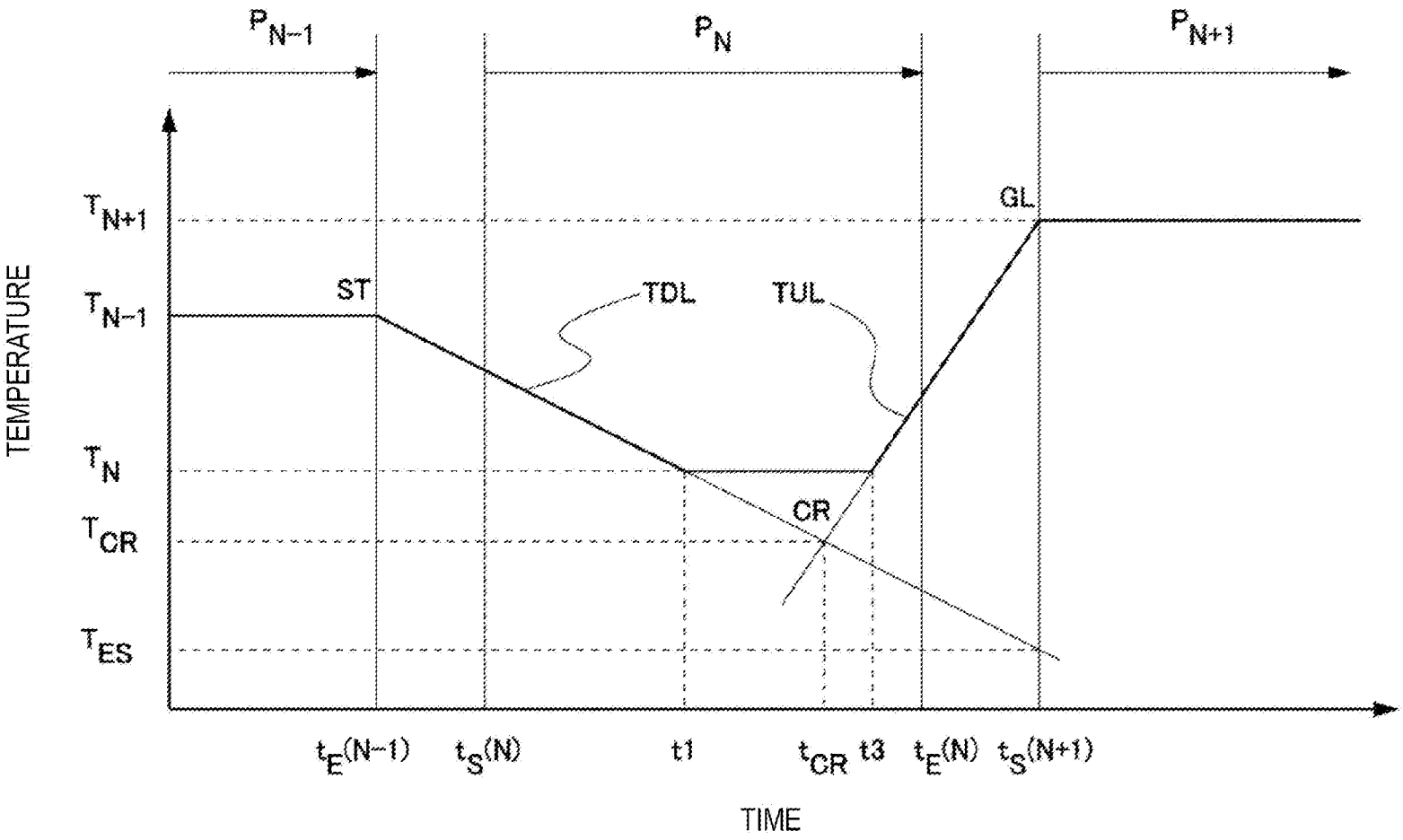
FIG. 12 is a graph showing yet another example of a temporal variation in the temperature of the fixing member shown in FIG. 1.

FIG. 12 is a graph showing yet another example of a variation in the temperature of the fixing roller 31 with time. As shown in FIG. 12, in three periods $P_{N-1}$, $P_N$, and $P_{N+1}$, the (N−1)th sheet, the Nth sheet, and the (N+1)th sheet are sequentially fed to the fixing unit 30, as in the example shown in FIG. 3.

Unlike the example shown in FIG. 3, the example shown in FIG. 12 is based on the assumption that "a toner image having an area equal to or larger than the lower limit value is to be formed on each of the (N−1)th sheet, the Nth sheet, and the (N+1)th sheet, but the amount of toner required for forming the toner image on the Nth sheet is smaller than the amounts of toner required for forming the toner images on the other sheets". In this case, the target value $T_N$ determined for the Nth sheet is lower than $T_{N-1}$ and $T_{N+1}$ determined for the (N−1)th sheet and the (N+1)th sheet, and each difference is equal to or larger than an allowable difference that is 20° C., for example.

The instructing unit 513 senses that the target value $T_N$ for the Nth sheet is lower than $T_{N-1}$ and $T_{N+1}$ for the respective sheets immediately before and after the Nth sheet by the allowable difference or more, and causes the fixing unit 30 to stop the temperature increasing operation or the like at the end time $t_E(N-1)$ of the fixing process for the (N−1)th sheet. As a result, after the end time $t_E(N-1)$, the temperature of the fixing roller 31 drops.

While the temperature increasing operation or the like of the fixing unit 30 remains suspended, the temperature drop rate calculating unit 511 calculates the temperature drop rate $-\Delta T^D$ of the fixing roller 31 from measured values supplied from the temperature sensor 34, and, using this calculated value $-\Delta T^D$, estimates the straight line TDL approximating the temperature drop curve of the fixing roller 31 after the time $t_E(N-1)$. From this temperature drop curve TDL, it is assumed that "if the temperature increasing operation or the like of the fixing unit 30 remains suspended, the temperature of the fixing roller 31 is lower than the target value $T_{N+1}$ for the (N+1)th sheet at the start time $t_S(N+1)$ of the fixing process for the (N+1)th sheet. Based on this assumption, the instructing unit 513 causes the temperature rise rate predicting unit 512 to predict the temperature rise rate of the fixing roller 31, estimates the straight line TUL approximating the temperature rise curve having this predicted value as its tilt, and determines the time $t_{CR}$ or the temperature $T_{CR}$ indicated by the coordinates of the intersection point CR between the straight line TUL and the temperature drop curve TDL.

While the temperature increasing operation or the like of the fixing unit 30 remains suspended, the Nth sheet is fed to the fixing unit 30. From the temperature drop curve TDL shown in FIG. 12, it is assumed that "if the temperature increasing operation or the like of the fixing unit 30 remains suspended, the time t1 (hereinafter referred to as the "first time") when the temperature of the fixing roller 31 drops to the target value $T_N$ (hereinafter referred to as the "first temperature") for the Nth sheet is earlier than the end time $t_E(N)$ of the fixing process for the Nth sheet: $t1<t_E(N)$".

In this case, if the first time t1 is earlier than the time $t_{CR}$ (hereinafter referred to as the "second time") indicated by the coordinates of the intersection point between the temperature drop curve and the temperature rise curve as shown in FIG. 12, or if the first temperature $T_N$ is higher than the temperature $T_{CR}$ (hereinafter referred to as the "second temperature") indicated by the coordinates of the intersection point as shown in FIG. 12, the instructing unit 513 instructs the fixing unit 30 to start the temperature adjusting operation at the first time t1. As a result, after the first time t1, the temperature of the fixing unit 30 is maintained at the first temperature $T_N$. The instructing unit 513 further instructs the fixing unit 30 to resume the temperature increasing operation at the time t3 (hereinafter referred to as the "third time") paired with the first temperature or the target value $T_N$ for the Nth sheet on the temperature rise curve TUL. If the first time t1 is equal to or later than the second time $t_{CR}$, or if the first temperature $T_N$ is equal to or lower than the second temperature $T_{CR}$, the instructing unit 513 instructs the fixing unit 30 to resume the temperature increasing operation at the second time $t_{CR}$.

After the third time t3 at which the temperature increasing operation is resumed or the second time $t_{CR}$, the temperature of the fixing roller 31 rises along the temperature rise curve TUL, and reaches the target value $T_{N+1}$ for the (N+1)th sheet by the start time $t_S(N+1)$ of the fixing process for the (N+1)th sheet.

—Flowcharts of the Temperature Control—

The flowcharts of the temperature control to be performed by the control unit 50 on the fixing roller 31 are substantially the same as those shown in FIGS. 5 to 8, but the details of step S506 for determining whether to cause the fixing unit 30 to resume the temperature increasing operation partially differs from those shown in FIG. 7. Therefore, only the different aspects from step S506 will be described below, as the other aspects have been described above with reference to FIGS. 5 to 8.

Figure 13:
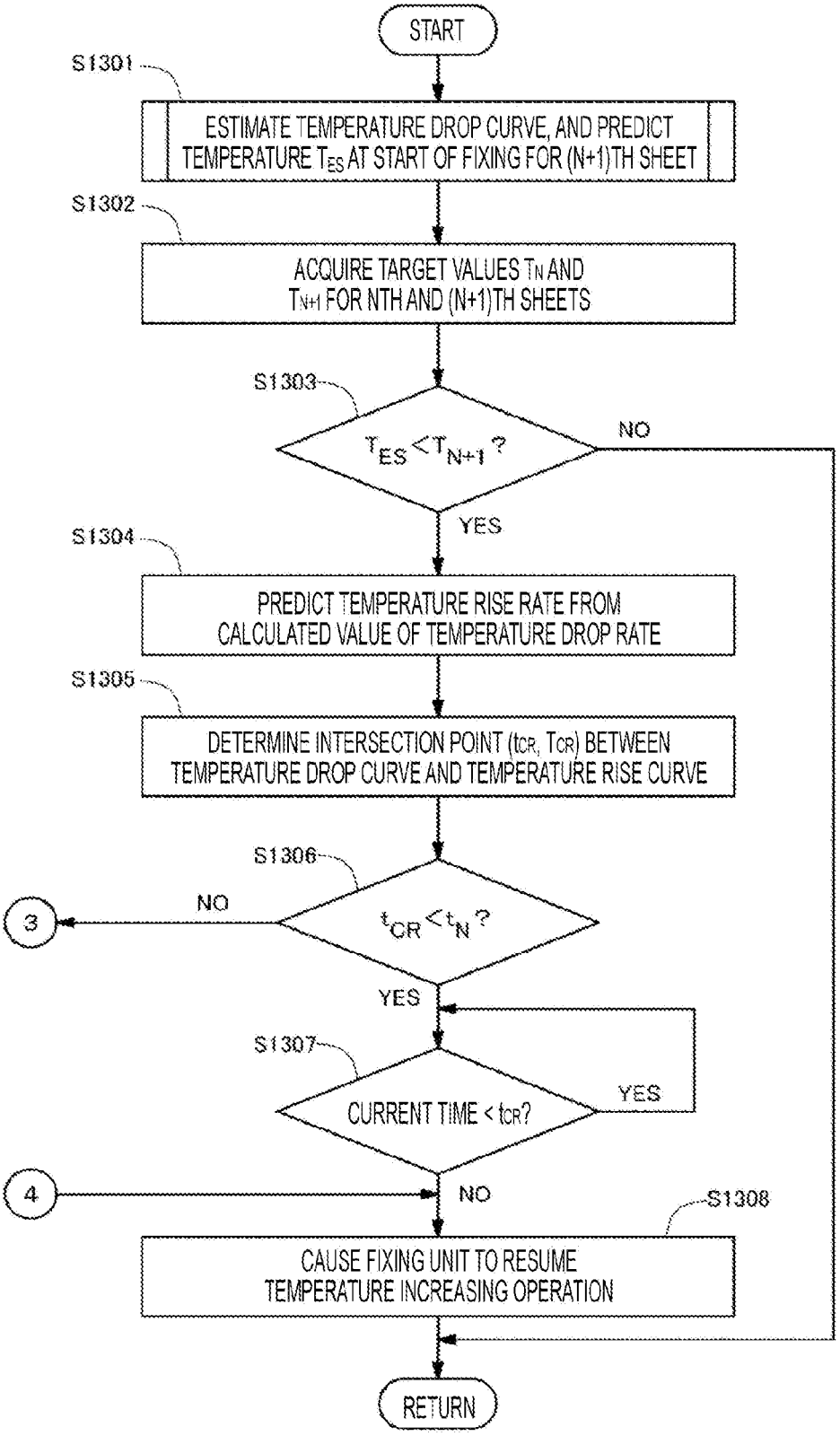
FIG. 13 is the main portion of a flowchart of step S506 shown in FIG. 5 or the process of determining whether to cause the fixing unit to resume a temperature increasing operation in the temperature control being performed on the fixing member to realize the temporal variation shown in FIG. 11.
Figure 14:
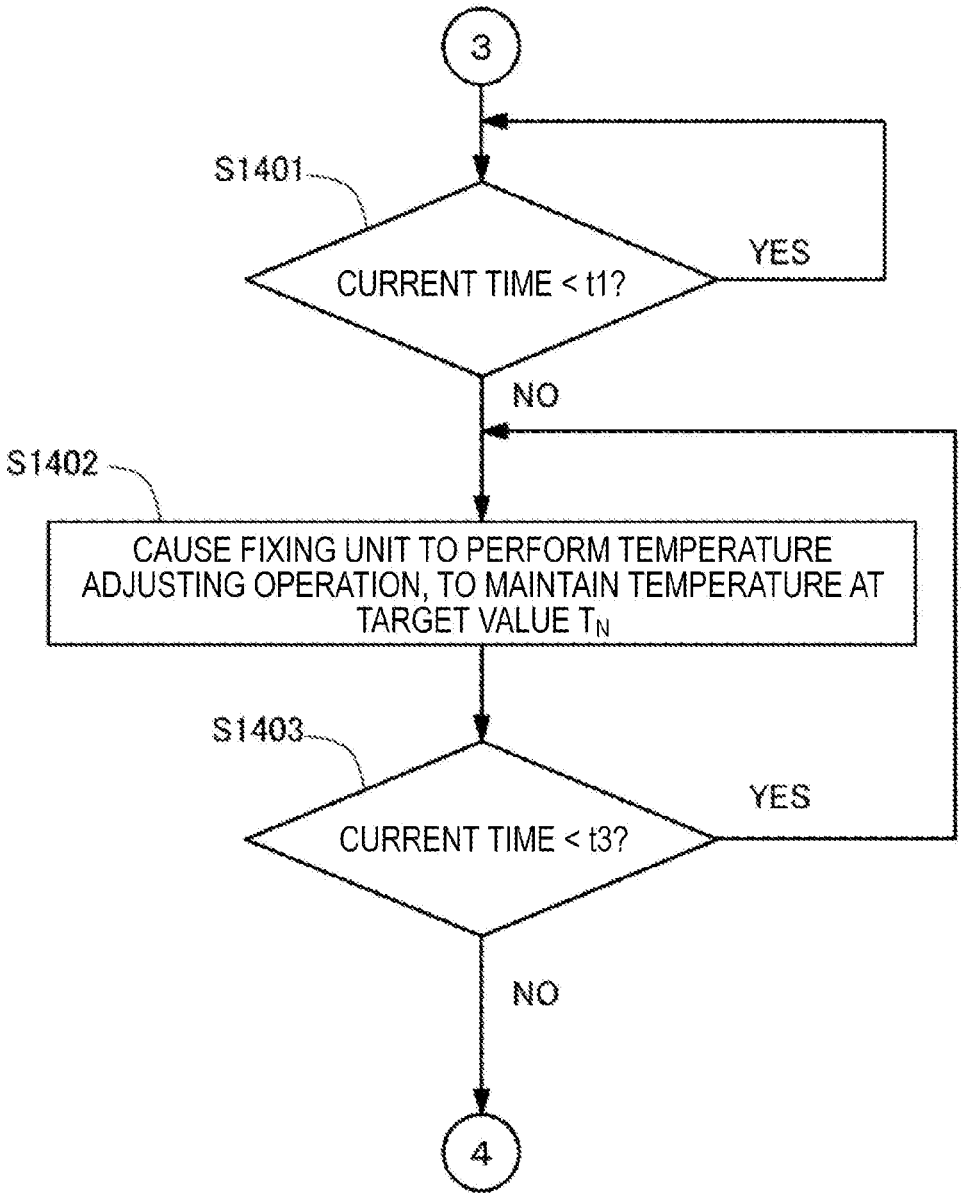
FIG. 14 is a flowchart that complements the main portion of the flowchart shown in FIG. 13.

FIGS. 13 and 14 are flowcharts of step S506 shown in FIG. 5, or the process of determining whether to cause the fixing unit 30 to resume the temperature increasing operation. In the description below, the target value $T_N$ for the Nth sheet is lower than $T_{N-1}$ and $T_{N+1}$ for the (N−1)th sheet and the (N+1)th sheet, as shown in FIG. 12.

In step S1301, from measured values supplied from the temperature sensor 34, the temperature drop rate calculating unit 511 estimates the temperature drop curve of the fixing roller 31 during a suspended period of the temperature increasing operation or the like of the fixing unit 30. Under the assumption that "the temperature increasing operation or the like of the fixing unit 30 remains suspended", the temperature drop rate calculating unit 511 further predicts, from the temperature drop curve, the temperature $T_{ES}$ of the fixing roller 31 at the time $t_S(N+1)$ when the feeding of the (N+1)th sheet to the fixing unit 30 is started. After that, the process moves on to step S1302.

In step S1302, the instructing unit 513 acquires the target values $T_N$ and $T_{N+1}$ for the Nth sheet and the (N+1)th sheet. After that, the process moves on to step S1303.

In step S1303, the instructing unit 513 compares the predicted value $T_{ES}$ of the temperature of the fixing roller 31 at the time $t_S(N+1)$ when the feeding of the (N+1)th sheet to the fixing unit 30 is started, with the target value $T_{N+1}$ for the (N+1)th sheet. If the predicted value $T_{ES}$ is smaller than the target value $T_{N+1}$ the process moves on to step S1304. If the predicted value $T_{ES}$ is not smaller than the target value $T_{N+1}$, the process returns to the flowchart shown in FIG. 5, and the procedures starting from step S501 are repeated.

In step S1304, it is assumed that "if the temperature increasing operation of the fixing unit 30 remains suspended, the temperature $T_{ES}$ of the fixing roller 31 is lower than the target value $T_{N+1}$ for the (N+1)th sheet at the time $t_S$(N+1) when the feeding of the (N+1)th sheet to the fixing unit 30 is started". Based on this assumption, the instructing unit 513 causes the temperature rise rate predicting unit 512 to predict the temperature rise rate of the fixing roller 31. After that, the process moves on to step S1305.

In step S1305, the instructing unit 513 estimates the temperature rise curve from the value of the temperature rise rate predicted by the temperature rise rate predicting unit 512, and determines the coordinates ($t_{CR}$, $T_{CR}$) of the intersection point between the temperature rise curve and the temperature drop curve. After that, the process moves on to step S1306.

In step S1306, the instructing unit 513 determines, from the temperature drop curve, the time or the first time t1 at which the temperature of the fixing roller 31 drops to the target value $T_N$ for the Nth sheet, and compares the first time ti with the second time $t_{CR}$ indicated by the coordinates of the intersection point. If the first time t1 is equal to or later than the second time $t_{CR}$, the process moves on to step S1307. If the first time t1 is earlier than the second time $t_{CR}$, the process moves on to step S1401.

In step S1307, the first time t1 is equal to or later than the second time $t_{CR}$, the instructing unit 513 monitors whether the second time $t_{0R}$ has come. The process is suspended until the second time $t_{CR}$ comes. If the second time $t_{CR}$ has already come, the process moves on to step S1308.

In step S1308, the instructing unit 513 instructs the power supply unit 60 to resume the power supply to the heater 31A in the fixing unit 30. Accordingly, the fixing unit 30 resumes the temperature increasing operation. After that, the process returns to the flowchart shown in FIG. 5, and the procedures starting from step S501 are repeated.

In step S1401, the first time t1 is earlier than the second time $t_{CR}$, the instructing unit 513 monitors whether the first time t1 has come. The process is suspended until the first time t1 comes. If the first time t1 has already come, the process moves on to step S1402.

In step S1402, the instructing unit 513 instructs the power supply unit 60 to resume the power supply to the heater 31A in the fixing unit 30. As a result, the fixing unit 30 starts the temperature adjusting operation, and after the first time t1, maintains the temperature of the fixing roller 31 at the first temperature or the target value $T_N$ for the Nth sheet. After that, the process moves on to step S1403.

In step S1403, the instructing unit 513 monitors whether the third time t3 has come. The temperature adjusting operation in step S1402 is repeated until the third time t3 comes. If the third time t3 has already come, the process moves on to step S1308.

An embodiment of the present invention relates to temperature control on the fixing member in an image forming apparatus, and is used in predicting a temperature rise rate after a temperature drop rate is calculated from measured values of the temperature of the fixing member. Accordingly, it is apparent that embodiments of the present invention can be used in industries.

According to an embodiment of the present invention, in the above described image forming apparatus of the present invention, while the temperature of the fixing member is dropping due to a stop of the temperature increasing operation of the fixing unit, the temperature drop rate of the fixing member is calculated from the actual temperature of the fixing member measured by the measuring unit, and the temperature rise rate of the fixing member at the time when the fixing unit is made to resume the temperature increasing operation is predicted from the calculated temperature drop rate. Through an actual variation in the temperature of the fixing member, the calculated value of the temperature drop rate reflects the state of the fixing unit at a time of actual printing. Accordingly, the accuracy of the prediction of the temperature rise rate becomes higher, as the calculated value of the temperature drop rate is used in predicting the temperature rise rate. In this manner, this image forming apparatus can prevent printing quality degradation caused by insufficient thermal fixing, and reduce the power consumption required for the temperature increasing operation of the fixing unit.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a sheet feeding unit configured to feed a plurality of sheets to an image forming unit one by one;

the image forming unit configured to form a toner image based on image data, the toner image being formed on each sheet supplied from the sheet feeding unit;

a fixing unit configured to fix the toner image formed on each sheet by the image forming unit with a fixing member, the fixing unit including the fixing member configured to be brought into contact with each sheet supplied from the image forming unit and heat each sheet;

a measuring unit configured to measure a temperature of the fixing member; and a control unit configured to instruct the fixing unit to start and stop a temperature increasing operation, and provide the image data to the image forming unit, wherein the control unit includes:

a temperature drop rate calculating unit configured to calculate a temperature drop rate of the fixing member from the value measured by the measuring unit while the temperature of the fixing member is dropping due to a stop of the temperature increasing operation of the fixing unit;

a temperature rise rate predicting unit configured to predict, a temperature rise rate of the fixing member at a time when the fixing unit is made to resume the temperature increasing operation, the temperature rise rate is determined based on the temperature drop rate calculated by the temperature drop rate calculating unit; and an instructing unit configured to determine a time or a temperature of the fixing member at which the fixing unit is to be made to resume the temperature increasing operation on condition that, by the time when the fixing unit thermally fixes the toner image, the temperature of the fixing member has reached a target value to be maintained at the time, and instruct the fixing unit to resume the temperature increasing operation at the determined time or when the value measured by the measuring unit drops to the determined temperature, the instructing unit using the temperature rise rate predicted by the temperature rise rate predicting unit in determining the time or the temperature.

2. The image forming apparatus according to claim 1, wherein the temperature drop rate calculating unit estimates a temperature drop curve indicating a temporal variation of the temperature of the fixing member by using the calculated temperature drop rate while the temperature of the fixing member is dropping due to a stop of the temperature increasing operation of the fixing unit, and the instructing unit estimates a temperature rise curve indicating a relationship between the time to resume the temperature increasing operation of the fixing unit and the temperature of the fixing member at the time when the condition is satisfied, using the temperature rise rate predicted by the temperature rise rate predicting unit, and determine the time to cause the fixing unit to resume the temperature increasing operation or the temperature of the fixing member, using coordinates of an intersection point between the temperature drop curve and the temperature rise curve.

3. The image forming apparatus according to claim 2, wherein, based on an assumption that the temperature increasing operation of the fixing unit remains suspended, the instructing unit predicts a temperature of the fixing member from the temperature drop curve at a time when the fixing unit thermally fixes the toner image, and, when the predicted temperature becomes lower than the target value to be maintained at the time, determines the time to cause the fixing unit to resume the temperature increasing operation or the temperature of the fixing member.

4. The image forming apparatus according to claim 2, wherein, while the temperature increasing operation of the fixing unit remains suspended, a sheet is supplied from the fixing unit, and the temperature drop curve indicates that the temperature of the fixing member drops to a first temperature to be maintained during the fixing process at a first time earlier than the time for the fixing unit to end the fixing process for the one sheet, when the first time is earlier than a second time indicated by the coordinates of the intersection point between the temperature drop curve and the temperature rise curve, or the first temperature is higher than a second temperature indicated by the coordinates of the intersection point, the instructing unit instructs the fixing unit to start a temperature adjusting operation at the first time, and, when the first time is equal to or later than the second time, or the first temperature is equal to or lower than the second temperature, the instructing unit instructs the fixing unit to resume the temperature increasing operation at the second time.

5. An image forming apparatus comprising:

a sheet feeding unit configured to feed a plurality of sheets to an image forming unit one by one;

the image forming unit configured to form a toner image based on image data, the toner image being formed on each sheet supplied from the sheet feeding unit;

a fixing unit configured to fix the toner image formed on each sheet by the image forming unit with a fixing member, the fixing unit including the fixing member configured to be brought into contact with each sheet supplied from the image forming unit and heat each sheet;

a measuring unit configured to measure a temperature of the fixing member; and a control unit configured to instruct the fixing unit to start and stop a temperature increasing operation, and provide the image data to the image forming unit, wherein the control unit includes:

a temperature drop rate calculating unit configured to calculate a temperature drop rate of the fixing member from the value measured by the measuring unit while the temperature of the fixing member is dropping due to a stop of the temperature increasing operation of the fixing unit;

a temperature rise rate predicting unit configured to predict, from the temperature drop rate calculated by the temperature drop rate calculating unit, a temperature rise rate of the fixing member at a time when the fixing unit is made to resume the temperature increasing operation;

an instructing unit configured to determine a time or a temperature of the fixing member at which the fixing unit is to be made to resume the temperature increasing operation on condition that, by the time when the fixing unit thermally fixes the toner image, the temperature of the fixing member has reached a target value to be maintained at the time, and instruct the fixing unit to resume the temperature increasing operation at the determined time or when the value measured by the measuring unit drops to the determined temperature, the instructing unit using the temperature rise rate predicted by the temperature rise rate predicting unit in determining the time or the temperature, and wherein the temperature rise rate predicting unit predicts a higher temperature rise rate when the temperature drop rate calculated by the temperature drop rate calculating unit is lower.

6. The image forming apparatus according to claim 5, wherein the temperature rise rate predicting unit uses a calculation in predicting the temperature rise rate, the calculation being based on an assumption that a difference between an actual value of the temperature rise rate and a reference value for the temperature rise rate is proportional to a difference between the value of the temperature drop rate calculated by the temperature drop rate calculating unit and a reference value for the temperature drop rate.

7. An image forming apparatus comprising:

a sheet feeding unit configured to feed a plurality of sheets to an image forming unit one by one;

the image forming unit configured to form a toner image based on image data, the toner image being formed on each sheet supplied from the sheet feeding unit;

a fixing unit configured to fix the toner image formed on each sheet by the image forming unit with a fixing member, the fixing unit including the fixing member configured to be brought into contact with each sheet supplied from the image forming unit and heat each sheet;

a measuring unit configured to measure a temperature of the fixing member; and a control unit configured to instruct the fixing unit to start and stop a temperature increasing operation, and provide the image data to the image forming unit, wherein the control unit includes:

a temperature drop rate calculating unit configured to calculate a temperature drop rate of the fixing member from the value measured by the measuring unit while the temperature of the fixing member is dropping due to a stop of the temperature increasing operation of the fixing unit;

a temperature rise rate predicting unit configured to predict, from the temperature drop rate calculated by the temperature drop rate calculating unit, a temperature rise rate of the fixing member at a time when the fixing unit is made to resume the temperature increasing operation;

an instructing unit configured to determine a time or a temperature of the fixing member at which the fixing unit is to be made to resume the temperature increasing operation on condition that, by the time when the fixing unit thermally fixes the toner image, the temperature of the fixing member has reached a target value to be maintained at the time, and instruct the fixing unit to resume the temperature increasing operation at the determined time or when the value measured by the measuring unit drops to the determined temperature, the instructing unit using the temperature rise rate predicted by the temperature rise rate predicting unit in determining the time or the temperature;

an image analyzing unit configured to analyze the image data and create, for each sheet, toner amount information indicating an amount of toner necessary for the image forming unit to form a toner image based on the image data, and the instructing unit determines, for each sheet, the target value at which the temperature of the fixing member is to be maintained at the time when the fixing unit thermally fixes the toner image.

8. The image forming apparatus according to claim 7 wherein, based on the toner amount information, the instructing unit detects a boundary in a transition from a sheet requiring a toner amount equal to or larger than a threshold value for forming a toner image, to a sheet requiring a smaller toner amount than the threshold value among the plurality of sheets, and instructs the fixing unit to stop the temperature increasing operation at the time when the fixing unit ends the fixing process for the sheet located immediately before the boundary.

9. The image forming apparatus according to claim 7, wherein, when a target value determined for a first sheet between two successive sheets of the plurality of sheets is lower than a target value determined for the next sheet by an allowable difference or more, the instructing unit instructs the fixing unit to stop the temperature increasing operation at the time when the fixing unit ends the fixing process for the first sheet.

10. The image forming apparatus according to claim 7, wherein, among the plurality of sheets, for a sheet not having a target value determined therefor yet for a reason that a toner amount is not specified in the toner amount information, the instructing unit determines that an allowable upper limit value of the temperature of the fixing member is the target value until the toner amount information is updated.

11. The image forming apparatus according to claim 1, further comprising an environmental temperature measuring unit configured to measure an internal or ambient temperature of the fixing unit, wherein, to predict the temperature rise rate, the temperature rise rate predicting unit further uses the value measured by the environmental temperature measuring unit.

12. The image forming apparatus according to claim 1, wherein, to predict the temperature rise rate, the temperature rise rate predicting unit further uses an attribute of each sheet to be fed to the fixing unit.

13. The image forming apparatus according to claim 1, wherein the fixing unit includes:

a pressing unit configured to press a supplied sheet against the fixing member; and a detecting unit configured to detect a temperature of the pressing unit, and, to predict the temperature rise rate, the temperature rise rate predicting unit further uses the value detected by the detecting unit.

14. The image forming apparatus according to claim 1, further comprising a power supply unit configured to supply the fixing unit with power necessary for the temperature increasing operation, wherein, when instructing the fixing unit to stop the temperature increasing operation, the instructing unit causes the power supply unit to cut off the power supply to the fixing unit.

15. The image forming apparatus according to claim 1, wherein the fixing member is movable between a first position in contact with a sheet traveling in the fixing unit and a second position not in contact with the sheet, and, when instructed to stop the temperature increasing operation by the instructing unit, the fixing unit moves the fixing member to the second position.

* * * * *